US006414669B1

(12) United States Patent
Masazumi

(10) Patent No.: US 6,414,669 B1
(45) Date of Patent: Jul. 2, 2002

(54) DRIVING METHOD AND APPARATUS FOR LIQUID CRYSTAL DISPLAY DEVICE

(75) Inventor: Naoki Masazumi, Kobe (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/273,531

(22) Filed: Mar. 22, 1999

Related U.S. Application Data

(60) Provisional application No. 60/100,882, filed on Sep. 23, 1998.

(30) Foreign Application Priority Data

May 14, 1998 (JP) ..... 10-132012

(51) Int. Cl.[7] ..... G09G 3/36

(52) U.S. Cl. ..... 345/98; 345/99; 345/100; 345/101; 345/102; 345/103; 345/104

(58) Field of Search ..... 345/98, 99, 100, 345/101, 102, 103, 104

(56) References Cited

U.S. PATENT DOCUMENTS

| | | | | |
|---|---|---|---|---|
| 4,097,127 A | * | 6/1978 | Hass et al. | |
| 5,384,067 A | | 1/1995 | Doane et al. | |
| 5,666,173 A | * | 9/1997 | Mase et al. | 349/61 |
| 5,699,074 A | * | 12/1997 | Sutherland et al. | 345/90 |
| 5,717,421 A | * | 2/1998 | Katakura et al. | 345/101 |
| 5,719,590 A | * | 2/1998 | Shimada et al. | 345/94 |
| 5,731,861 A | | 3/1998 | Hatano et al. | |
| 5,748,277 A | * | 5/1998 | Huang et al. | 349/169 |
| 5,929,833 A | * | 7/1999 | Koshobu et al. | 345/101 |
| 5,933,203 A | * | 8/1999 | Wu et al. | 349/35 |
| 6,052,103 A | * | 4/2000 | Fujiwara et al. | 345/89 |
| 6,215,540 B1 | * | 4/2001 | Stephenson | 349/139 |

FOREIGN PATENT DOCUMENTS

| | | | |
|---|---|---|---|
| EP | 0 772 067 | | 7/1997 |
| JP | 62-175714 | * | 8/1987 |
| JP | 10-90646 | | 10/1998 |
| WO | WO 98/31002 | | 7/1998 |

* cited by examiner

*Primary Examiner*—Richard Hjerpe
*Assistant Examiner*—Jean Lesperance
(74) *Attorney, Agent, or Firm*—Burns, Doane, Swecker & Mathis, LLP

(57) ABSTRACT

A technique is described for driving a liquid crystal display device having a liquid crystal layer exhibiting a cholesteric phase and switchable between a planar state and a focal conic state according to the magnitude of an applied voltage. The technique comprises the steps of: in a first period, simultaneously applying a voltage by which a plurality of pixels arranged in a matrix array are reset to the focal conic state; in a second period after the first period, sequentially applying voltages corresponding to image data to the pixels, thereby updating the display contents of the pixels; and in a third period after the second period, retaining the display state by utilizing memory characteristics of the liquid crystal.

40 Claims, 32 Drawing Sheets

Fig. 6
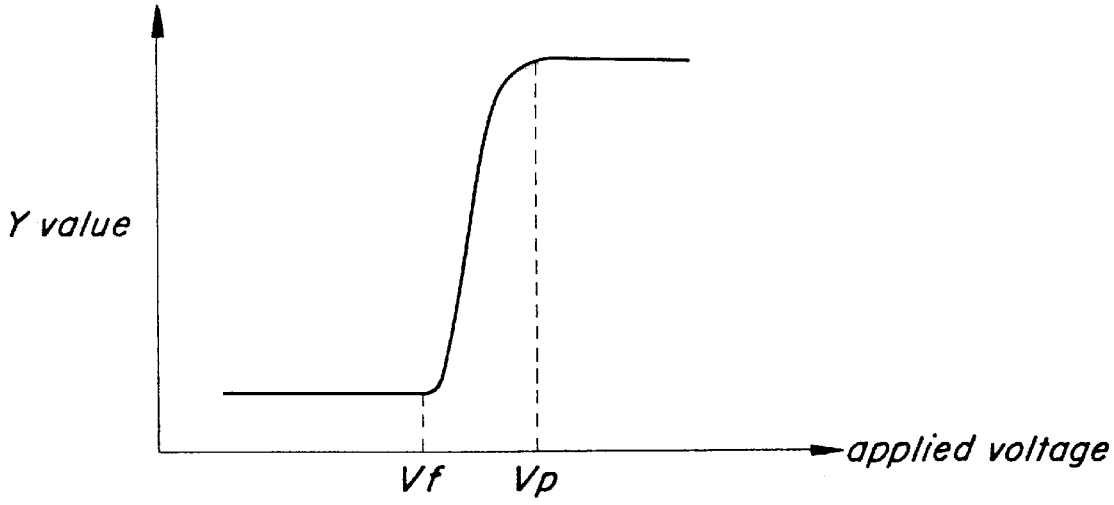
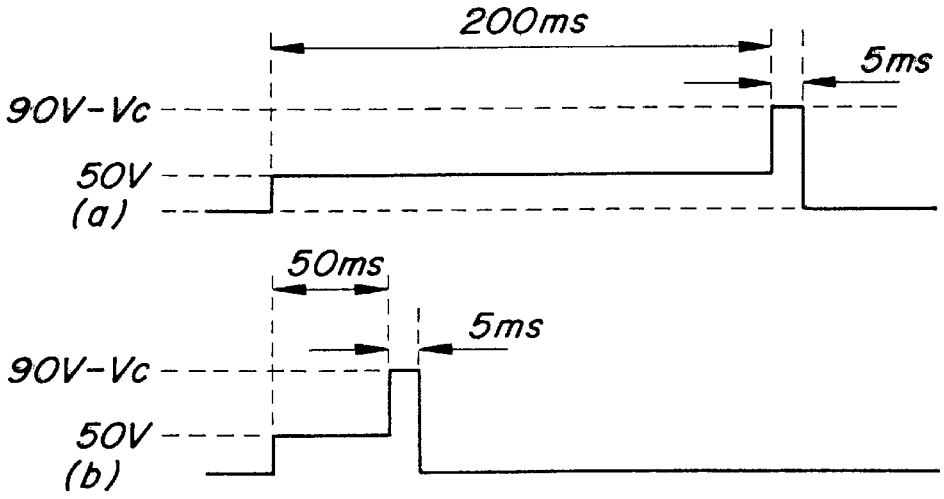
Fig. 7

Fig. 20
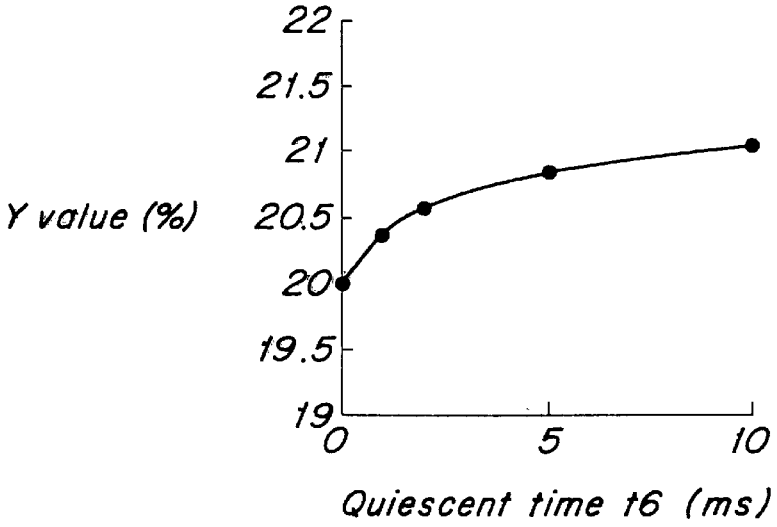
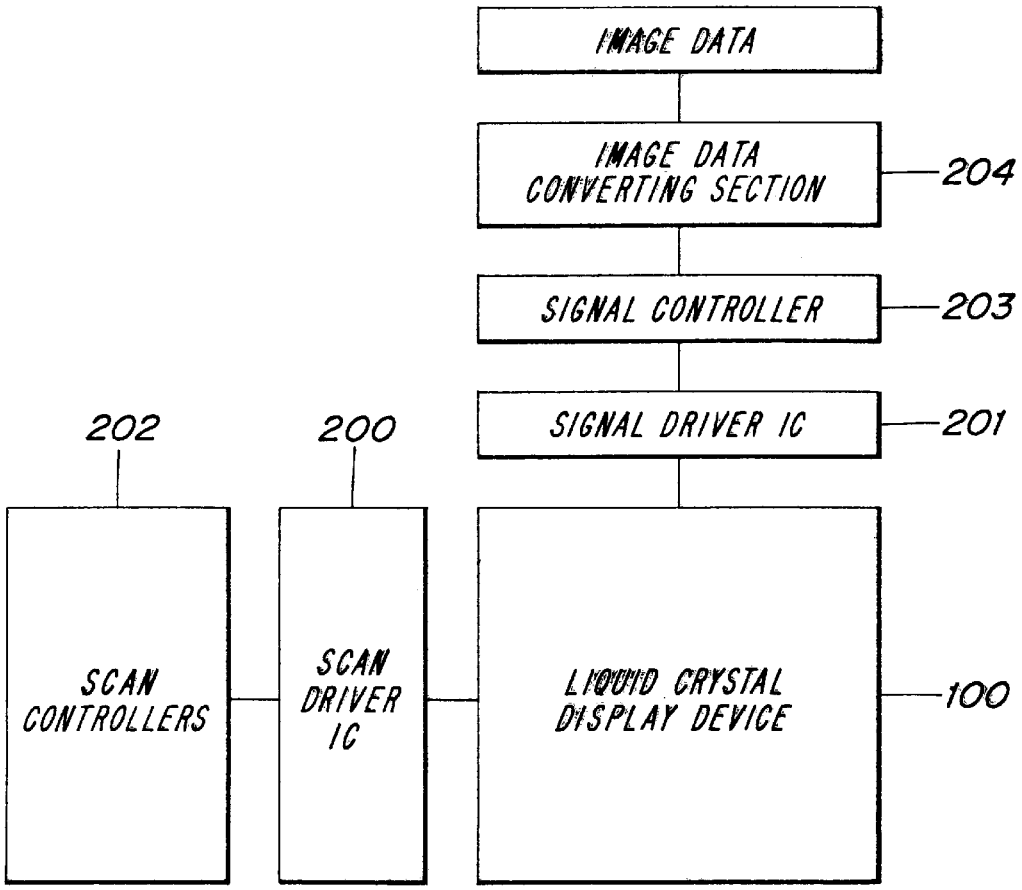
Fig. 21

201

LIQUID CRYSTAL DISPLAY DEVICE
OUTPUT SECTION
224
232
231
PWM CIRCUIT
COMPARATOR
COMPARATOR
COMPARATOR
COMPARATOR
COMPARATOR
8BIT COUNTER
COUNT CLOCKS
223
DATA STROBE SIGNAL
LATCH
222
DATA SHIFT CLOCK
IMAGE DATA
8
SHIFT REGISTER
221

DRIVING METHOD AND APPARATUS FOR LIQUID CRYSTAL DISPLAY DEVICE

This application claims the benefit of U.S. Provisional Application No. 60/100,882, filed on Sep. 23, 1998, which is hereby incorporated by reference in its entirety. This application is also based on Japanese Application No. 10-132012, filed on May 14, 1998, which is also hereby incorporated by reference in its entirety.

BACKGROUND

Field of the Invention

The present invention relates to a driving method for a liquid crystal display device, and more particularly to a driving method for a liquid crystal display device in which a liquid crystal exhibiting a cholesteric phase is sandwiched between two substrates having electrodes arranged in a matrix form on their surfaces, and which creates a display by changing the state of the liquid crystal by a voltage applied across the electrodes.

In a liquid crystal display device with a cholesteric liquid crystal or chiral nematic liquid crystal sandwiched between two substrates, a display is created by switching the state of the liquid crystal between a planar state and a focal conic state. When the liquid crystal is in the planar state, light with wavelength $\lambda=P\cdot n$ is selectively reflected, where P is the helical pitch of the cholesteric liquid crystal and n is the average refractive index of the liquid crystal. In the focal conic state, when the selective reflection wavelength of the cholesteric liquid crystal is in the infrared region, the liquid crystal scatters light, and when the reflection wavelength is shorter than that, the liquid crystal transmits visible light. Accordingly, by setting the selective reflection wavelength within the visible light region, and providing a light absorbing layer on the side of the display device opposite the side thereof viewed by the observer, selective reflection color can be displayed in the planar state, and black in the focal conic state. On the other hand, by setting the selective reflection wavelength within the infrared region, and providing a light absorbing layer on the side of the display device opposite the side thereof viewed by the observer, black can be displayed in the planar state, since the light of wavelengths in the infrared region is reflected but the light of wavelengths within the visible spectrum is transmitted through the liquid crystal, and white can be displayed in the focal conic state because of light scattering.

Here, let Vth1 denote a first threshold voltage for unwinding the twist of the liquid crystal exhibiting the cholesteric phase; then, after the voltage Vth1 is applied for a sufficient amount of time, when the voltage is lowered below a second threshold voltage Vth2 smaller than the first threshold voltage Vth1, the planar state results. When a voltage larger than Vth2 but smaller than Vth1 is applied for a sufficient amount of time, the focal conic state results. These two states are stable even after the applied voltage is removed. Further, a phase in which these two states are mixed is known to exist, and it is known that a gray scale display is possible (refer to U.S. Pat. No. 5,384,067).

In this way, since the liquid crystal exhibiting the cholesteric phase has the memory characteristic that can retain the display state in the absence of an applied voltage, a desired image or character can be displayed by driving the display device, divided into many pixels, by passive matrix addressing. However, since this kind of liquid crystal has a hysteresis characteristic, for the same applied voltage the display state can differ depending on the previous state of the liquid crystal.

To overcome this deficiency, the present assignee proposed a driving method in which, after resetting the state of the liquid crystal to the homeotropic state by applying a voltage greater than Vth1, a plurality of write pulse voltages are applied and the state of the liquid crystal is selected by the magnitude of the applied voltage. This driving method applies pulse waveforms such as shown in FIG. 37, to the liquid crystal. Of the three pulses shown, the first pulse 401 is the pulse for resetting the state of the liquid crystal to the homeotropic state, and has a pulse width P1 and voltage V1. The second and third pulses 402 and 403 are the pulses for selecting the state of the liquid crystal, and both have the same pulse width P3 and voltage V2. The pulses 401, 402, and 403 are separated from one another by a wait time P2 during which no voltage is applied. The wait time P2 between the first and second pulses 401 and 402 is the time necessary for the liquid crystal to change from the homeotropic state to the planar state. The wait time P2 between the second and third pulses 402 and 403 is necessary to separate the pulses 402 and 403. In this driving method, the reflectivity of the device is a function of voltage, and gray scale can be reproduced by controlling the second and third pulse voltage V2.

SUMMARY

An exemplary object of the present invention is to provide a novel and useful driving method for a liquid crystal display device, that suppresses the degradation of display quality caused by the effect of the hysteresis, as in the above-described driving method, and achieves further improvements in the characteristics of the device. Particularly, it is an object of the invention to provide a driving method for a liquid crystal display device, that achieves a further reduction in driving time.

To achieve the above objects, in the driving method according to the present invention, liquid crystals in all the pixels are first reset at once to the focal conic state that requires a long time for selection, and then a select voltage is applied in sequence to the liquid crystal forming each pixel, thereby selecting the display state of the liquid crystal in every pixel.

According to the present invention, since all the pixels are simultaneously reset to the focal conic state, the long selection time required to select the focal conic state occurs only once in one frame. This improves the update speed in passive matrix driving.

BRIEF DESCRIPTION OF THE DRAWINGS

The foregoing and other objects, features and advantages of the present invention will be more readily understood upon reading the following detailed description in conjunction with the drawings, in which:

FIG. 6 is a graph showing the relationship between Y value and the applied voltage as a select signal in the first embodiment;

FIG. 7 is a chart diagram showing voltage waveforms used in Example 1;

FIG. 20 is a graph showing the Y values obtained in Example 5;

FIG. 21 is a block diagram showing drive circuits used in a sixth embodiment;

DETAILED DESCRIPTION OF THE INVENTION

Embodiments of the driving method for a liquid crystal display device according to the present invention will be described below with reference to the accompanying drawings.

Structure of the Liquid Crystal Display Device

Figure 1:
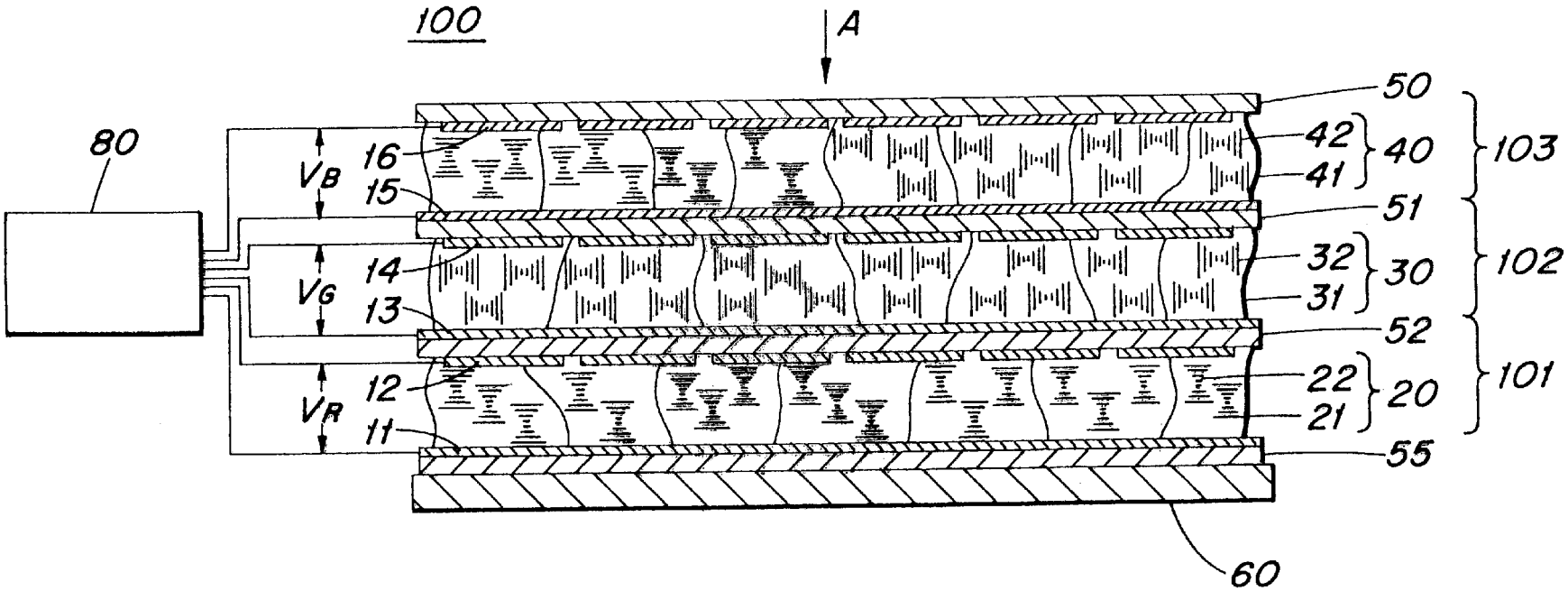
FIG. 1 is a cross sectional view showing an example of a liquid crystal display device used in the present invention.

FIG. 1 shows the liquid crystal display device 100 to be driven by the driving method of the present invention. The liquid crystal display device 100 comprises: a red display layer 101, formed on top of a light absorbing member 60, for producing a display by switching between red selective reflection state and transparent state; a green display layer 102, formed on top of the red display layer 101, for producing a display by switching between green selective reflection state and transparent state; and a blue display layer 103, formed on top of the green display layer 102, for producing a display by switching between blue selective reflection state and transparent state.

The red display layer 101 consists of a transparent substrate 55, transparent electrodes 11, a liquid crystal/polymer composite film 20 formed by dispersing through a polymeric member 21 a liquid crystal 22 exhibiting red selective reflection, transparent electrodes 12, and a transparent substrate 52, formed one on top of another.

The green display layer 102 consists of the transparent substrate 52, transparent electrodes 13, a liquid crystal/polymer composite film 30 formed by dispersing through a polymeric member 31 a liquid crystal 32 exhibiting green selective reflection, transparent electrodes 14, and a transparent substrate 51, formed one on top of another.

The blue display layer 103 consists of the transparent substrate 51, transparent electrodes 15, a liquid crystal/polymer composite film 40 formed by dispersing through a polymeric member 41 a liquid crystal 42 exhibiting blue selective reflection, transparent electrodes 16, and a transparent substrate 50, formed one on top of another.

The transparent electrodes 11, 12, 13, 14, 15, and 16 are connected to a drive circuit 80, which applies prescribed pulse voltages between the transparent electrodes 11 and 12, between the transparent electrodes 13 and 14, and between the transparent electrodes 15 and 16, respectively. In response to the applied voltages, the liquid crystal/polymer composite films 20, 30, and 40 switch the respective display states between the transparent state that transmits visible light and the selective reflection state that selectively reflects visible light.

The transparent electrode pairs, 11 and 12, 13 and 14, and 15 and 16, forming the respective color display layers 101, 102, and 103, are each formed from a plurality of microscopically spaced, paralleled stripe electrodes, the opposing stripe electrodes being oriented at right angles to each other. These top and bottom stripe electrodes are sequentially energized. That is, voltages are sequentially applied in a matrix form to the respective liquid crystal/polymer composite films 20, 30, and 40, to create a display. This is known as matrix driving. By applying such matrix driving to the respective color display layers sequentially or simultaneously, a full color image is displayed on the liquid crystal display device 100.

By providing the light absorbing member 60 at the lowermost layer as viewed from the viewing direction (the direction of arrow A), light transmitted through the respective color display layers 101, 102, and 103 is all absorbed by the light absorbing member 60. That is, when all the color display layers are in the transparent state, the result is a black display. The light absorbing member 60 can be constructed, for example, from a black colored film. Alternatively, the light absorbing member 60 may be formed by coating the undermost surface of the display device with a black paint such as black ink.

In FIG. 1, the red display layer 101 is shown in the planar state, the green display layer 102 in the focal conic state, and the blue display layer 103 in a state in which both the planar state and the focal conic state exist.

For the transparent substrates 50, 51, 52, and 55, colorless transparent glass plates or polymeric films made, for example, of polyether sulfon, polycarbonate, or polyethylene terephthalate, can be used. For transparent electrodes 11, 12, 13, 14, 15, and 16, transparent electrodes made, for example, of ITO or NESA films can be used, and such films are deposited by sputtering or vacuum evaporation on the transparent substrates 50, 51, 52, and 55. For the lowermost transparent electrodes 11, black electrodes can be used so that it will also serve as the light absorbing member.

The transparent substrates 51 and 52 used here are each constructed with a single substrate with transparent electrodes formed on both sides thereof, but instead, each transparent substrate may be constructed by bonding together two transparent substrates, each with transparent electrodes formed only on one side, back to back with an adhesive transparent polymeric material interposed therebetween.

For each of the liquid crystal/polymer composite films 20, 30, and 40, a liquid crystal/resin composite member obtained, for example, by the phase separation of liquid crystal and resin (photo-polymerization induced phase separation) can be used; in this method, a mixture of a liquid crystal and a photo-setting resin material is sandwiched between a pair of transparent substrates, and the photo-setting resin is cured by irradiating ultraviolet light or the like, thus inducing the phase separation. In this case, the thickness of the liquid crystal/polymer composite film can be easily controlled by inserting, together with the mixture, particulate or rod-like spacers between the transparent substrates.

For the fabrication of the liquid crystal display device 100, a method can be used in which the color display layers 101, 102, and 103 are separately formed by photo-polymerization induced phase separation, and then the color display layers are bonded together using an adhesive polymeric material or the like. It is also possible to employ a method in which the three kinds of liquid crystals used to form the liquid crystal/polymer composite films 20, 30, and 40 are respectively mixed with a photo-setting resin, and the respective mixtures are sandwiched between the respective transparent substrates 50, 51, 52, and 55, as shown in FIG. 1, after which the three layers are cured at the same time by irradiating ultraviolet light, to complete the fabrication of the liquid crystal display device 100.

Cholesteric liquid crystals are used as the liquid crystals 22, 32, and 42 used for the formation of the liquid crystal/polymer composite films 20, 30, and 40. Cholesteric liquid crystals have a layer structure in which the liquid crystal molecules are aligned with their long axes in parallel to each other, and in each molecular layer, a helical structure is formed with the long axes of adjacent molecules slightly displaced from each other.

Cholesteric liquid crystals exhibiting the cholesteric phase at room temperature are particularly preferred for use. It is also possible to use chiral nematic liquid crystals that are obtained by adding a chiral dopant to nematic liquid crystals.

In nematic liquid crystals, rod-like molecules align in parallel to each other, but they do not form a layer structure. For the nematic liquid crystal, a liquid crystal consisting singly of a biphenyl compound, a tolan compound, a cyclohexane compound, or the like, or a liquid crystal consisting of a mixture of such compounds, can be used, and those having a positive dielectric anisotropy are preferred. Specific examples include liquid crystals K15 and M15 composed principally of a cyanobiphenyl compound, mixed liquid crystal MN1 (manufactured by Chisso Corporation), and E44, ZLI-1565, TL-213, and BL-035 (manufactured by Merck).

The chiral dopant is an additive which, when added to a nematic liquid crystal, acts to twist the molecules of the nematic liquid crystal. By adding the chiral dopant to the nematic liquid crystal, the liquid crystal molecules form a helical structure with a prescribed helical pitch, because of which the liquid crystal exhibits the cholesteric phase.

In the chiral nematic liquid crystal, the pitch of the helical structure can be varied by varying the amount of the chiral dopant to be added, the advantage being that the selective reflection wavelength of the liquid crystal can be controlled by varying the pitch. Generally, the term "helical pitch", which is defined as the intermolecular distance it takes for the liquid crystal molecules to rotate 360 degrees along the helical structure of the liquid crystal molecules, is used to describe the pitch of the helical structure of the liquid crystal molecules.

For the chiral dopant, a compound having an asymmetric carbon, and providing a layered helical structure to nematic liquid crystal molecules, can be used. Examples include such commercially available chiral dopants as S811 (manufactured by Merck), CB15 (manufactured by Merck), S1011 (manufactured by Merck), and CE2 (manufactured by Merck), which are obtained by bonding an optically active group as the terminal group of a nematic liquid crystal compound such as a biphenyl compound, a terphenyl compound, or ester compound. Cholesteric liquid crystals having a cholesteric ring represented by cholesteric nonanoate (CN) can also be used as the chiral dopant.

More than one kind of chiral dopant may be used as the chiral dopant to be added to the nematic liquid crystal; furthermore, in addition to a combination of dopants having the same optical activity, a combination of dopants having different optical activities can be used. Using multiple kinds of chiral dopants has the effect of enhancing the characteristics of the display device since it can change the physical properties of the cholesteric liquid crystal, such as dielectric anisotropy $\Delta\epsilon$, refractive index anisotropy "$\Delta n$, and viscosity $\eta$, in addition to changing the phase transition temperature of the cholesteric liquid crystal and reducing the sensitivity of the selective reflection wavelength to the temperature.

For the photo-setting resin materials 21, 31, and 41 used in the liquid crystal/polymer compound films 20, 30, and 40, a mixed solution of a photo-setting monomer or oligomer and a photo-polymerization initiator can be used; for example, various acrylic based monofunctional and polyfunctional resin materials can be used. Specific examples include adamanthylmethacrylate, TPA-320 (manufactured by Nippon Kayaku), and BF-530 (manufactured by Daihachi Kagaku). For the photo-polymerization initiator, a material that induces polymerization reaction, such as the radical polymerization of the photo-setting resin material, by irradiation of ultraviolet light, for example, can be used, specific examples including DAROCUR1173 and IRGACUR814 manufactured by Ciba Geigy.

When using a mixed solution of a photo-setting monomer or oligomer and a photo-polymerization initiator, such as described above, the photo-polymerization induced phase separation method can be employed for the formation of the liquid crystal/resin composite film, in which the mixed solution is mixed with a liquid crystal and ultraviolet light is irradiated to cure the resin material, thus causing the phase separation of the liquid crystal and resin.

In the liquid crystal/polymer composite films 20, 30, and 40 using such chiral nematic liquid crystals, when the selective reflection wavelength of the cholesteric liquid crystal is in the visible light region and the liquid crystal molecules are in the focal conic alignment state in which the helical axis of the cholesteric liquid crystal molecules is substantially parallel to the substrate surfaces, the liquid crystal is substantially transparent, transmitting most of the incident visible light, though it exhibits slight scattering. In the planar alignment state in which the helical axis of the cholesteric liquid crystal molecules is substantially perpendicular to the substrate surfaces, of the incident visible light the light having a wavelength that matches the helical pitch is selectively reflected. The liquid crystal state can be switched between these two states by varying a field such as an electric field, magnetic field, or temperature, and each state is retained after the field is removed.

Utilizing the above properties, liquid crystal/polymer composite films that selectively reflect light with wavelengths corresponding to red, green, and blue, respectively, in the planar alignment state, and that become transparent transmitting visible light in the focal conic alignment state, can be obtained by adjusting the amount of the chiral dopant to be added to the nematic liquid crystal, and thereby adjusting the helical pitch of the chiral nematic liquid crystal to provide the selective reflective wavelengths corresponding to red light, green light, and blue light, respectively. By sandwiching the thus obtained liquid crystal/polymer composite films between the respective transparent electrodes, a color liquid crystal display device is obtained.

Addition of Pigments and Placement of Color Filters for Improved Color Purity and Improved Contrast Here, in order to improve the color purity of the display created by selective reflection in the color display layers 101, 102, and 103, and to absorb light components that can degrade the transparency in the transparent state, pigments may be added in the color display layers, or colored filter layers having equivalent effects, that is, plate members such as colored glass filters or color films, may be placed on the color display layers. Pigments may be added to any of the materials forming the color display layers, that is, to the liquid crystal material, the resin material, or the transparent substrate material, and more than one constituent element may contain pigments. However, to prevent the degradation of display quality, it is desirable that the pigments and filter layers to be added be selected so as not to affect the color display produced by selective reflection in each of the color display layers.

Figure 2:
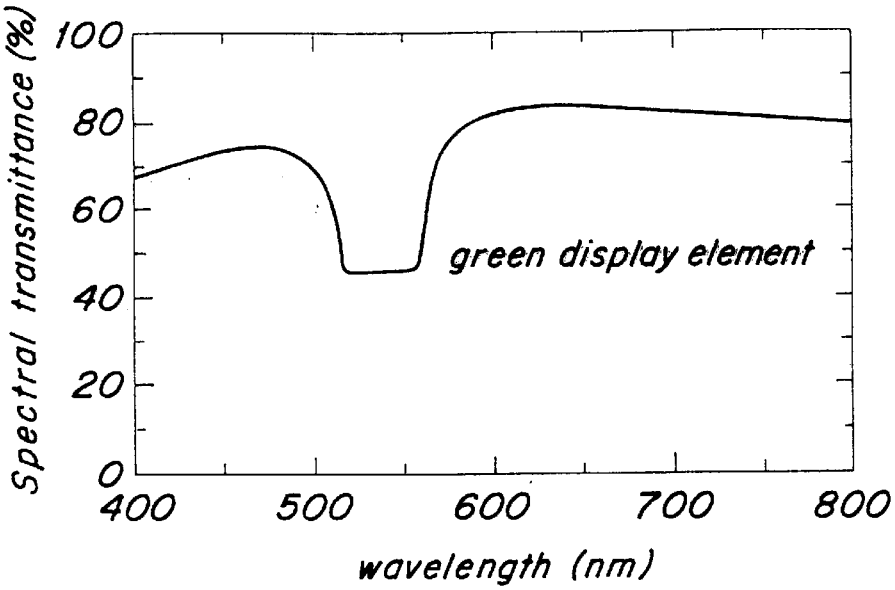
FIG. 2 is a graph showing the spectral transmittance of a green liquid crystal display layer used in the present invention.

FIG. 2 shows one example of spectral transmittance of the green display element. Light wavelength is plotted along the abscissa and the transmittance of the display element along the ordinate. In the green display element, light near 550 nm wavelength is selectively reflected, and the transmittance is low in that wavelength region. Further, the transmittance in the wavelength region below 500 nm is lower than that in the wavelength region above 600 nm. The reason is that, according to the research conducted by the inventor, et al., light with wavelengths longer than the selective reflection wavelength of the liquid crystal can easily transmit through the liquid crystal/polymer composite film, while on the contrary, light with wavelengths shorter than the selective reflection wavelength of the liquid crystal tends to scatter inside the liquid crystal/polymer composite film, this tendency increasing as the wavelength becomes shorter. As a result, in the case of a liquid crystal/polymer composite film that creates a display by selective reflection in the longer wavelength region, in particular, the red color, the color purity of the red color degrades due to the scattered blue light and the contrast drops because of increased reflectivity of the black color displayed in the transparent state. Therefore, if a light absorbing material such as a pigment is added to the liquid crystal/polymer composite film to absorb the blue light, the contrast and the color purity of the red color are improved, and the display quality can thus be improved effectively. In the case of the liquid crystal display elements for creating the green color display and blue color display, the effect of increasing the color purity in the selective reflection state by pigment addition is smaller than in the case of the red color display, but the same effect as in the red color display can be obtained for the improvement of the contrast.

Various prior known pigments can be used as the pigments added in the liquid crystal display device 100. For example, various dyes such as resin dyeing pigments, dichromatic pigments for liquid crystal display, etc. can be used. Specific examples of resin dyeing pigments include SPR-Red1 and SPR-Yellow1 (both manufactured by Mitsui Toatsu Dye). Specific examples of dichromatic pigments for liquid crystal display include SI-426 and M-483 (both manufactured by Mitsui Toatsu Dye). Pigments that do not affect the display by selective reflection of the cholesteric liquid crystals 22, 32, and 42, and that absorb spectrum light in the wavelength region that can lead to the degradation of the display, should be selected appropriately for each color display layer from among the above listed pigments. Further, since it is thought that the light components that degrade the display quality lie mostly in the shorter wavelength region, as earlier described, it is further preferable to use pigments that absorb the spectrum light in the wavelength regions shorter than the respective selective reflection wavelengths of the cholesteric liquid crystals 22, 32, and 42.

The amount of the pigment added is not specifically limited as long as it is within the range that does not cause an appreciable degradation in the switching operation characteristic of the liquid crystal display, and that does not interfere with the polymerization reaction for forming the polymeric members by polymerization; however, it is preferable to add the pigment at least 0.1 weight percent with respect to the liquid crystal/polymer composite film, and one weight percent would be sufficient.

When using color filters instead of adding pigments, colorless transparent materials with pigments added thereto may be used as the filter layer materials added in the liquid crystal display device 100. Materials naturally having colors without the addition of pigments, or thin films of particular materials having the same function as the pigments, may also be used. Specific examples of filter layers include commercially available color glass filters and Wratten gelatine filters No. 8 and No. 25 (manufactured by Eastman Kodak). Of course, it is apparent that the same effect can be obtained if the transparent substrates 50, 51, and 52 themselves are replaced with the filter layer materials as described above, instead of adding the filter layers.

Method of Color Display

In the liquid crystal display 100 with the color display layers 101, 102, and 103 formed one on top of another using the materials as described above, a red display can be created by setting the blue display layer 103 and the green display layer 102 in the transparent state with the cholesteric liquid crystals 42 and 32 in the focal conic alignment state, and the red display layer 101 in the selective reflection state with the cholesteric liquid crystal 22 in the planar alignment state. Further, a yellow display can be created by setting the blue display layer 103 in the transparent state with the cholesteric liquid crystal 42 in the focal conic alignment state, and the green display layer 102 and the red display layer 101 in the selective reflection state with the cholesteric liquid crystals 32 and 22 in the planar alignment state. Likewise, red, green, blue, white, cyan, magenta, yellow, and black can be displayed by suitably selecting the state of each color display layer between the transparent state and the selective reflection state. Further, by selecting an intermediate selective reflection state as the state of each of the color display layers 101, 102, and 103, an intermediate color can be displayed, and thus the display device can be used as a full color display device.

More specifically, the liquid crystal display 100 having the blue display layer 103, the green display layer 102 and the red display layer 101 can, in combination, display any color in a chromaticity diagram by supplying a predetermined voltage to the layers 103, 102 and 101. The predetermined voltage is selected from a highest voltage corresponding to a planar alignment state (e.g., a complete reflective state), a lowest voltage corresponding to a focal conic alignment state (e.g., a transparent state), and an intermediate voltage which is selected between the highest voltage and the lowest voltage. This intermediate voltage corresponds to an intermediate selective state (e.g., referred to as a "selective reflective state").

In other words, the drive circuit 80 can form different colors in a chromaticity diagram by supplying appropriate voltages to the layers 103, 102 and 101, the voltages ranging from a highest voltage (corresponding to a planar alignment state) and a lowest voltage (corresponding to the focal conic state). To perform this function, the drive circuit 80 can store (e.g., in a look-up table) predetermined combinations of voltages which are known to achieve desired colors. One of the predetermined combinations of voltages can be accessed by specifying a desired color, which can be associated with an address for use in accessing the predetermined combination of voltages. Those skilled in the art will appreciate that there are other ways of implementing this feature.

The color display layers 101, 102, and 103 in the liquid crystal display device 100 can be formed in a different order than that shown in FIG. 1. However, considering the fact that the transmittance is higher in the longer wavelength region that in the shorter wavelength region, the selective reflection wavelength of the cholesteric liquid crystal contained in the upper layer should be made shorter than the selective reflection wavelength of the cholesteric liquid crystal contained in the lower layer; by so arranging, a brighter display can be obtained since a larger amount of light is transmitted through to the lower layer. Accordingly, it is most desirable to arrange the blue display layer 103, the green display layer 102, and the red display layer 101 in this order as viewed from the observing side (from the direction of arrow A), and in this case, the most desirable display quality can be obtained.

Construction of a Display Device Capable of Producing a Brighter Display

Figure 3:
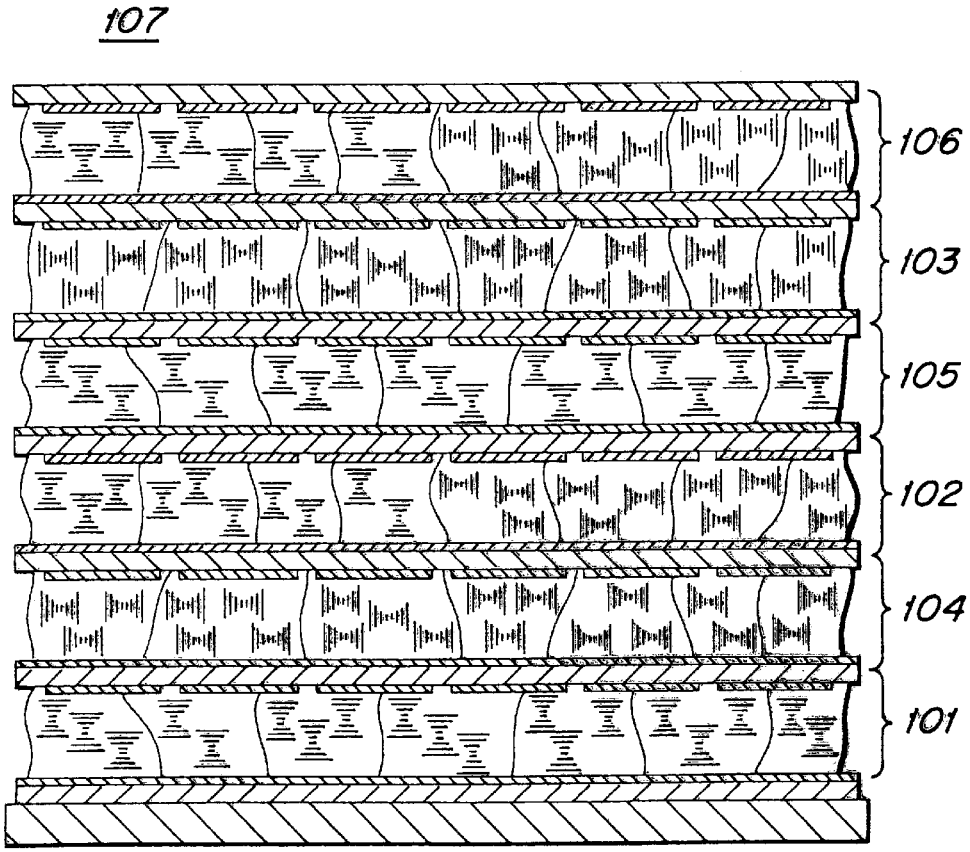
FIG. 3 is a cross sectional view showing an example of a high-reflectivity liquid crystal display device.

Selective reflection of cholesteric liquid crystal is the property that incident linearly polarized light is decomposed into right-handed and left-handed circularly polarized light components, and either one of them is reflected and the other transmitted. Therefore, the light utilization of each of the color display layers 101, 102, and 103 shown in FIG. 1 is 50% at maximum. In view of this, a liquid crystal display device 107 capable of producing a brighter display can be constructed, as shown in FIG. 3, wherein a red display layer 104 with the same selective reflection wavelength as the red display layer 101 but with the opposite sense of helix rotation, a green layer 105 with the same selective reflection wavelength as the green display layer 102 but with the opposite sense of helix rotation, and a blue display layer 106 with the same selective reflection wavelength as the blue display layer 103 but with the opposite sense of helix rotation, are formed on top of the respective color display layers so that both the right-handed and left-handed circularly polarized light components of each color are reflected. Further, by individually driving the color display layers of the same color but with opposite optical activities, the resolution of reproducible intermediate colors can be enhanced. The color display layers with opposite optical activities and the order of their formation is not specifically limited, but when the previously described spectral transmission characteristic is considered, the construction shown in FIG. 3 can produce the highest quality display.

The examples so far described have dealt with liquid crystal display devices using liquid crystal/polymer composite films, but the structure of the liquid crystal display device applicable for the driving method of the present invention is not limited to the illustrated examples; devices of other structures can be used as long as they are constructed using the above-described cholesteric liquid crystals. For examples, devices not containing polymers are also applicable. Further, a device in which a structure consisting of column-like or wall-like polymeric members is provided between the substrates by a printing method or photopolymerization method using a photomask, for example, is also applicable.

First Embodiment

Figure 4:
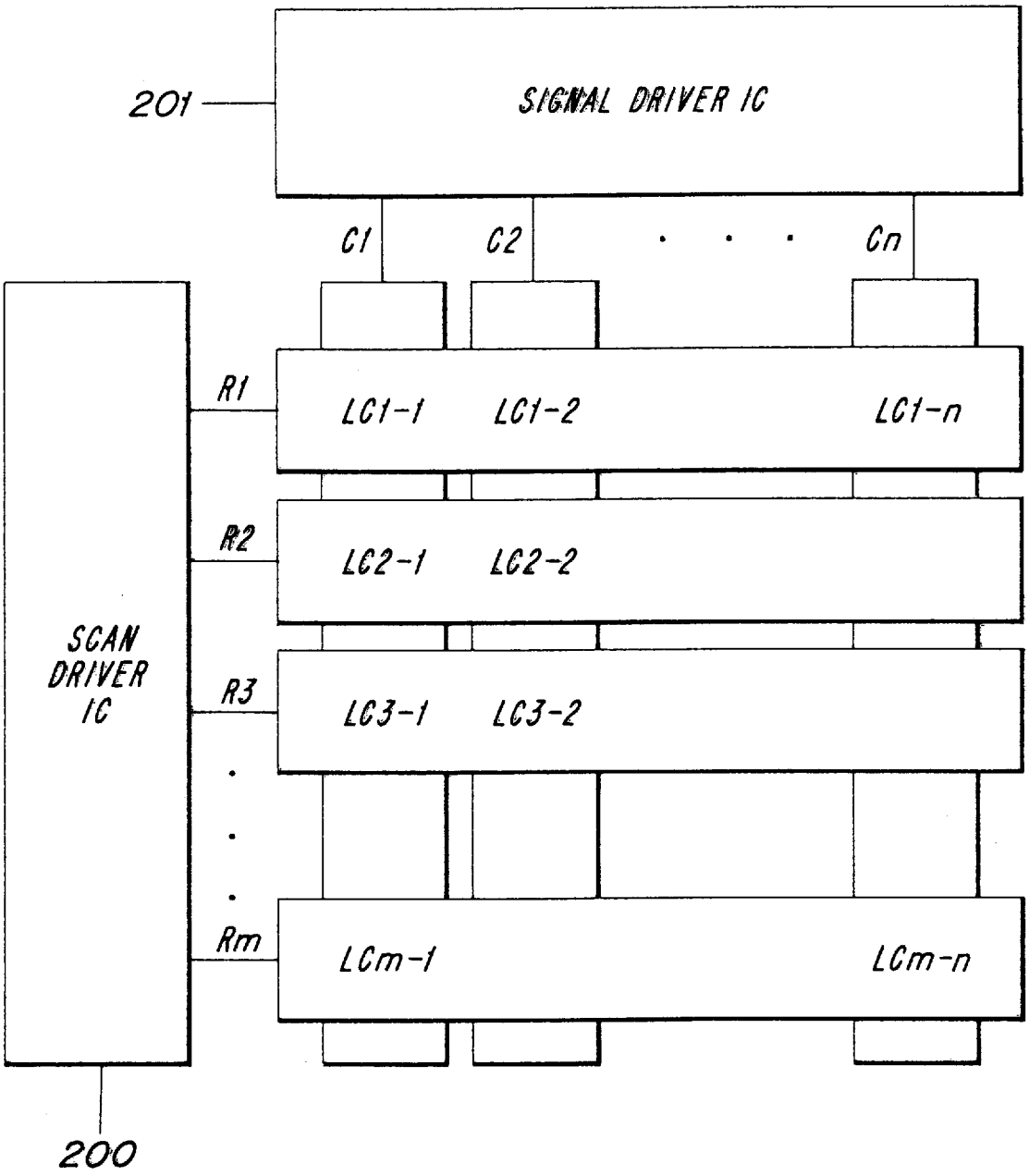
FIG. 4 is a block diagram showing passive matrix driving circuits.

Since the pixel configuration of the liquid crystal display device driven by the present invention is a passive matrix, the configuration can be represented by an m×n matrix consisting of scanning electrodes, R1 to Rm, and signal electrodes, C1 to Cn, as shown in FIG. 4. Intersections between the scanning electrodes Ra and signal electrodes Cb (a and b are natural numbers that satisfy $a \leqq m$ and $b \leqq n$) are pixels LCa–b. These electrode arrays are connected to the output terminals of a scan driver IC 200 and a signal driver IC 201, respectively, and voltages are applied from these driver ICs 200 and 201 to the respective electrodes.

Figure 5:
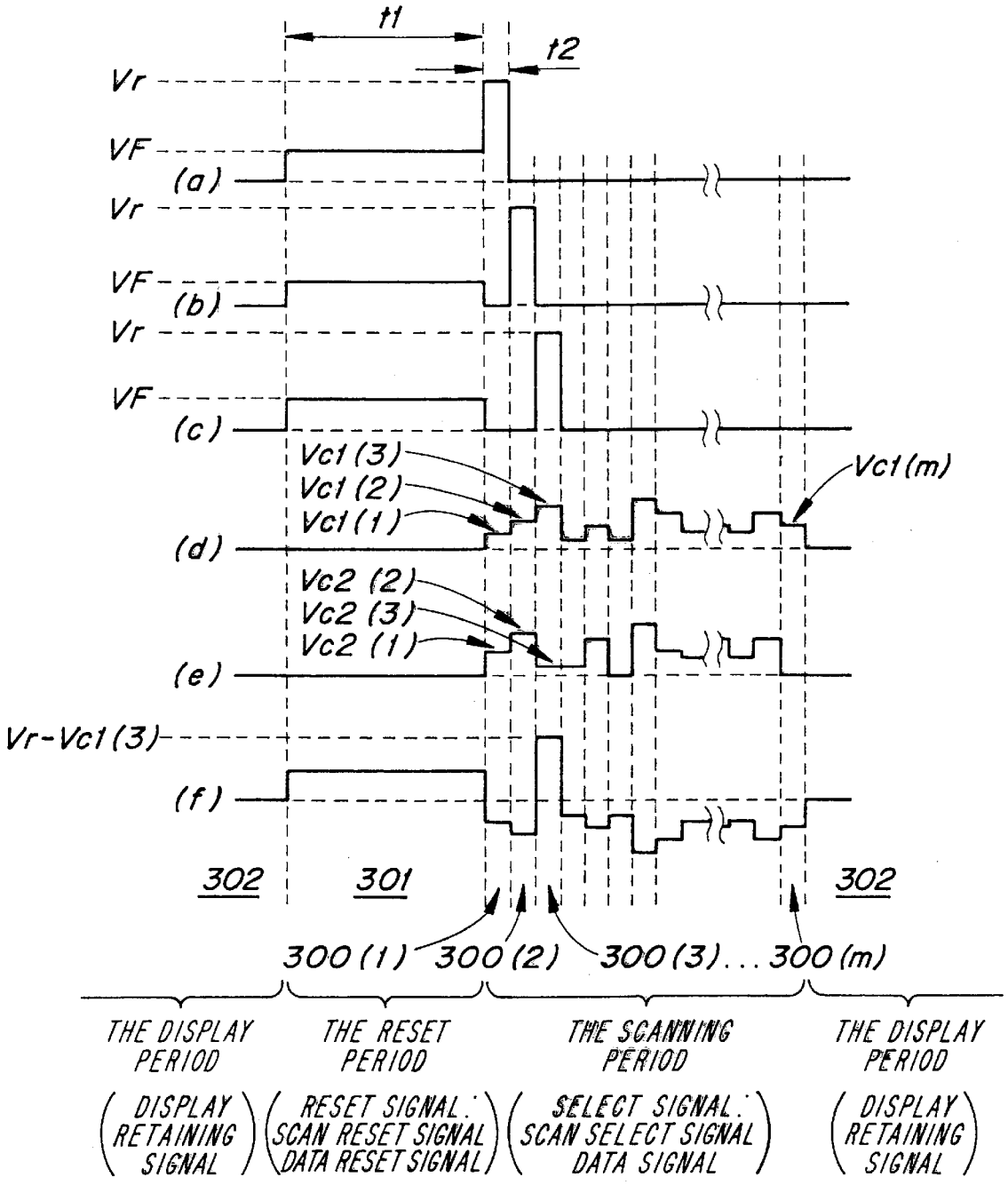
FIG. 5 is a chart diagram showing voltage waveforms used in a first embodiment.

This drive circuitry will be described below. FIG. 5 shows the voltage waveforms applied to the scanning electrodes and signal electrodes and the resulting voltage waveform applied to the liquid crystal. Waveforms (a), (b), and (c) are the voltage waveforms applied to the scanning electrodes R1, R2, and R3, respectively. Waveforms (d) and (e) are the voltage waveforms applied to the signal electrodes C1 and C2, respectively. Waveform (f) is the voltage waveform applied to the liquid crystal forming the pixel LC3-1 where the scanning electrode R3 and signal electrode C1 intersect. This waveform (f) is divided into periods 300(1) to 300(m), 301, and 302, and periods 300(1) to 300(m) are together referred to as the scanning period, 301 as the reset period, and 302 as the display period.

In the reset period 301, a pulse voltage of voltage VF and pulse width t1 is applied to the scanning electrodes R1 to Rm. This pulse voltage is referred to as the scan reset signal. In the reset period, no voltage is applied to the signal electrodes C1 to Cn. The signal applied to the signal electrodes during the reset period 301 is referred to as the data reset signal; in this example, the voltage is 0. By applying the scan reset signal and data reset signal, the pulse voltage of voltage VF and pulse width t1 is applied to the liquid crystal in every pixel during the reset period 301. This pulse voltage is referred to as the reset signal.

In 300(3) of the scanning period, the liquid crystal forming each pixel on the scanning electrode R3 is updated. The scanning electrode R3 responsible for updating at this time is referred to as the scan select electrode, and the other scanning electrodes are referred to as the scan deselect electrodes. The scanning period 300(3) is referred to as the scan select period of the scanning electrode R3. During the scan select period of the scanning electrode R3, a pulse voltage of voltage Vr and pulse width t2 is applied to the scanning electrode R3. This pulse voltage is referred to as the scan select signal. At the same time, a pulse voltage of voltage Vc1(3) and pulse width t2 is applied to the signal electrode C1. This pulse voltage applied to the signal electrode is referred to as the data signal. By applying the scan select signal and data signal, a pulse voltage of voltage Vr-Vc1(3) and pulse width t2 is applied to the liquid crystal LC3-1 located at the intersection of the scan select electrode R3 and signal electrode C1. This pulse voltage is referred to as the select signal.

In 300(1), 300(2), 300(4), . . . , 300(m) of the scanning period, the scanning electrode R3 is selected as a scan deselect electrode. Periods 300(1), 300(2), 300(4), . . . , 300(m) are together referred to as the deselect period of the scanning electrode R3. During the deselect period of the scanning electrode R3, no voltage is applied to the scanning electrode R3. The voltage here is 0, and this pulse voltage is referred to as the scan deselect signal. Data signals of voltages Vc1(1), Vc1(2), Vc1(4), . . . , Vc1(m), respectively, with the pulse width t2, are applied to the signal electrode C1. By applying the scan deselect signal and the data signals, pulse voltages of voltages −Vc1(1), −Vc1(2), −Vc1(4), . . . , −Vc1(m), respectively, with the pulse width t2, are applied to the liquid crystal LC3-1 located at the intersection of the scan deselect electrode R3 and signal electrode C1. These pulse voltages are together referred to as the deselect signal.

During the display period 302, no voltage is applied to the scanning electrodes R1 to Rm or the signal electrodes C1 to Cn. The pulse voltage at this time is referred to as the display retaining signal.

In the first embodiment, the display state of the liquid crystal is a function of the applied voltage and pulse width. After initially resetting each liquid crystal to the focal conic state that shows the lowest Y value, when a pulse voltage with constant width is applied to the liquid crystal the display state changes as shown in FIG. 6. In FIG. 6, the vertical axis represents the Y value of visual reflectivity, and the horizontal axis shows the applied voltage. When a pulse of voltage Vp is applied, the planar state showing the highest Y value is selected, and when a pulse of voltage Vf is applied, the focal conic state showing the lowest Y value is selected. When an intermediate voltage is applied, a planar/focal conic mixed state showing an intermediate Y value is selected, making it possible to reproduce gray scale.

Here, Vf is a voltage value that brings the liquid crystal closest to the focal conic state when the voltage is applied for a relatively short duration of time. On the other hand, VF is a voltage value that brings the liquid crystal closest to the focal conic state when the voltage is applied for a relatively long duration of time. Generally, Vf>VF.

The meaning of each signal will be described below.

The reset signal applied to the liquid crystal during the reset period 301 is applied at once to the liquid crystals in all the pixels in order to force the display state of all the pixels into the focal conic state. The voltage VF is the voltage for setting the cholesteric liquid crystal into the focal conic state. It is preferable to set the pulse width t1 to a sufficiently long time. The reason is that since the liquid crystal slowly changes to the focal conic state with the application of the voltage VF, if the voltage is not applied for a sufficiently long period of time, the liquid crystal is influenced by its previous state and all the pixels cannot be set uniformly in the focal conic state. Though it depends on the number of gray scale levels required, cell structure, etc., t1 can be set, for example, within the range of about 100 ms to 1s.

In the scanning period, the select signal and deselect signal are applied to the liquid crystal. The voltage of each signal is set as follows.

During the select period of a given scanning electrode Ri (i is an integer between 1 and m), the scan select signal of voltage Vr=Vp and pulse width t2 is applied to the scanning electrode Ri, and the data signal of voltage Vcj(i) and pulse width t2 is applied to a given signal electrode Cj (j is an integer between 1 and n). During the deselect period of the scanning electrode Ri, no voltage is applied to the scanning electrode Ri. In this way, during the select period of the scanning electrode Ri, a select pulse of pulse width t2 and voltage, Vr−Vcj(i)=Vp−Vcj(i), is applied to the liquid crystal forming the pixel located at the intersection of the scanning electrode Ri and signal electrode Cj. When Vcj(i) is selected from among voltages 0 to Vp−Vf, the select signal of pulse width t2 and voltage of a value between Vp and Vf is applied to the liquid crystal, thus allowing selection of the desired display state.

During the deselect period of the scanning electrode Ri, deselect signals of voltages 0 to Vp−Vf are applied to the liquid crystals forming the pixels on the scanning electrode Ri. The liquid crystals driven by the present invention have memory characteristics, so that their display states do not change at voltages below a certain threshold voltage. Accordingly, the display states of the liquid crystals can be retained if the deselect signal is held below the prescribed threshold voltage. To select the display states of the liquid crystals forming all the pixels, the scanning electrodes are scanned in sequence from R1 to Rm.

During the display period, no voltage is applied to the liquid crystals and the memorized display states are retained. That is, the voltages applied to the scanning electrodes and signal electrodes are set to 0 so that no voltage is applied to the liquid crystals.

The time required to update the entire screen is equal to the reset period plus the scanning period, that is, t1+m×t2. The time to select the focal conic state is longer than the time to select the planar state; therefore, t1>>t2. According to the driving method of the first embodiment, since the reset period that takes a long time does not increase in length even if the pixel count increases, the screen can be updated at high speed.

EXAMPLE 1

A liquid crystal composition for selectively reflecting light of wavelength near 560 nm was prepared by adding a chiral material S811 (manufactured by Merck) to a nematic liquid crystal MLC643 (manufactured by Merck). This liquid crystal composition was sandwiched between a pair of transparent substrates with transparent electrodes formed thereon. At this time, by precoating the substrates with 10 μm spacer particles, the substrate spacing was adjusted to 10 μm. A single-layer test cell was thus fabricated, and its characteristics as a liquid crystal display device were measured. The experiments hereinafter described were conducted using this test cell. Minolta's spectrophotometric colorimeter CM1000 was used for the measurement of the Y value of the visual reflectivity.

Figure 8:
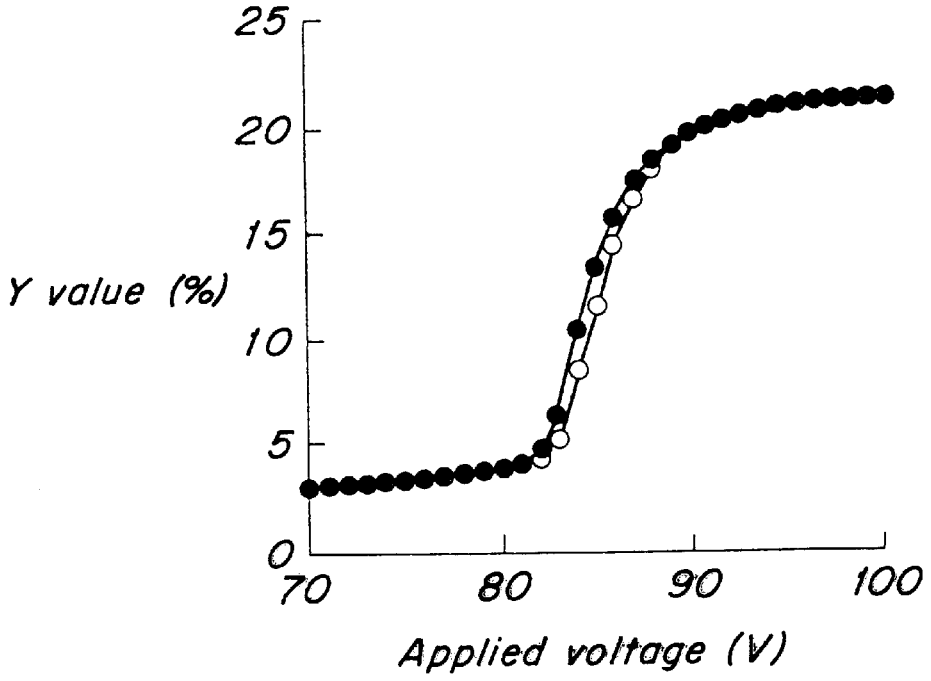
FIG. 8 is a graph showing the Y values obtained in Example 1.

Pulse voltage of the waveforms (a) and (b) shown in FIG. 7 were applied to the liquid crystal in the test cell. Only one pixel was chosen for testing, and only the select signal was applied during the scanning period. VF was set at 50 V and t2 at 5 ms. The waveform (a) is one with t1=200 ms, and the waveform (b) is one with t1=50 ms. The graph of FIG. 8 shows the Y value versus the applied voltage for select signal voltages Vs of 70 V to 100 V when the pulse voltage of the waveform (a) was applied. Open circles are for those whose initial state was the focal conic state, and solid circles are for those whose initial state was the planar state. The initial state here refers to the display state before the reset period. As shown, the Y value varies continuously with the applied voltage, which means that the desired Y value can be selected by controlling the applied voltage. When an intermediate gray scale level is selected, the Y value slightly differs for the same applied voltage because of the difference in the initial state, but this difference is sufficiently small when displaying four or so gray scale levels.

Figure 37:
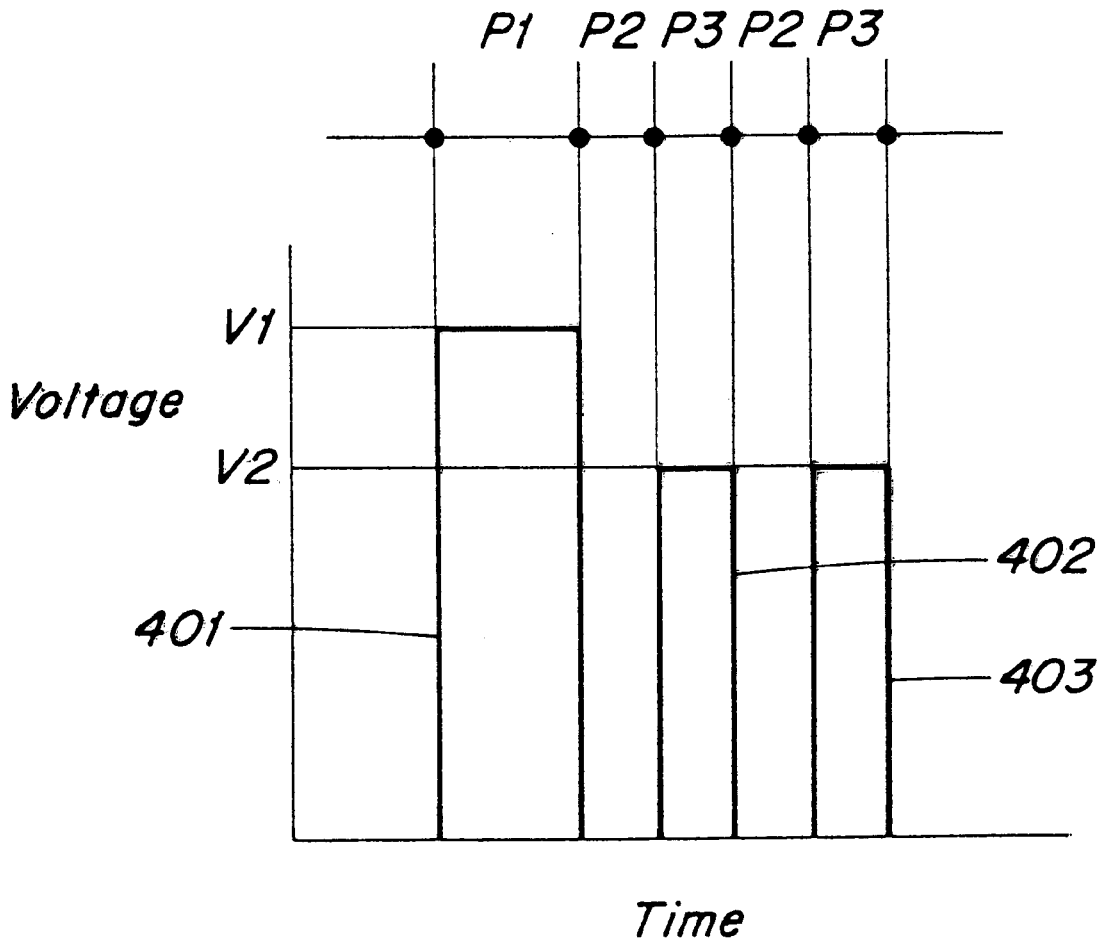
FIG. 37 is a chart diagram showing three basic pulse voltages for driving a liquid crystal display.

In the driving method shown in FIG. 37 previously described, the planar state or the focal conic state, or an intermediate state with these two states mixed together, is selected starting from the homeotropic state. When driving a liquid crystal display device that uses a liquid crystal whose selective reflection state is set in the visible light region, the planar state, i.e., the state of the highest reflectivity, can be selected with the second and third pulses 402 and 403 when P3 is about 1 ms to 5 ms. However, according to the study conducted by the inventor, et al., it was found that with P3 of about 1 ms to 5 ms, it was not possible to fully select the focal conic state of the lowest reflectivity, thus being unable to make full use of the maximum contrast achievable with the liquid crystal display device. The second and third pulses 402 and 403 with P3=about 50 ms were needed to make full use of the maximum contrast. This means 50 ms for each scanning electrode. Therefore, assuming 1000 lines, it took 50 seconds to update the entire screen. On the other hand, in the case of Example 1 based on the first embodiment, the time required for updating is 5.2 seconds, a drastic improvement over the prior art method. It can therefore be seen that when the method of the first embodiment is used, a display state having a desired Y value can be selected regardless of the initial state.

Figure 9:
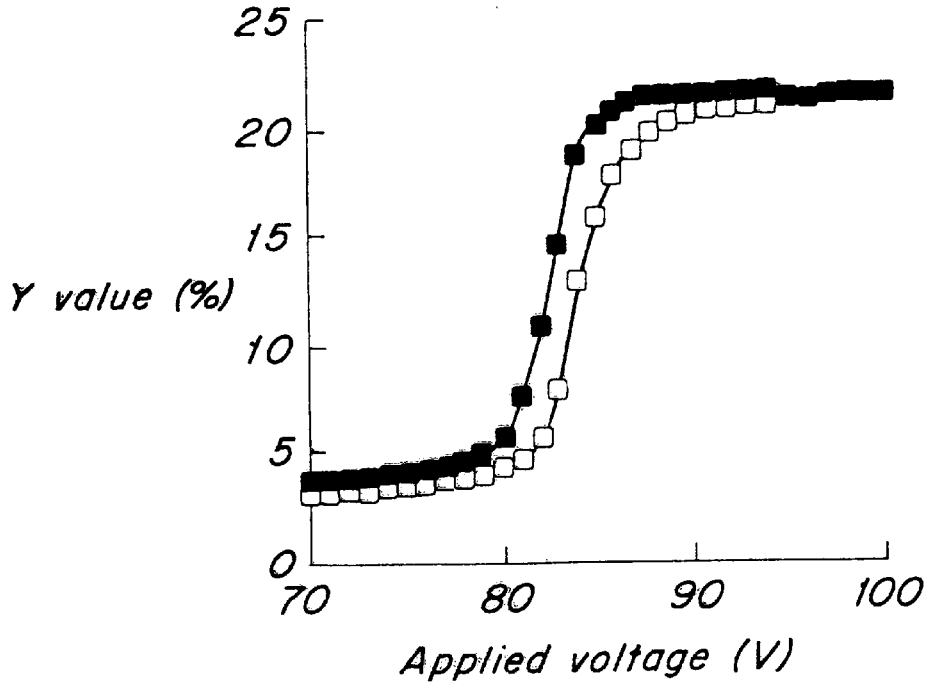
FIG. 9 is a graph showing the Y values obtained in Example 1.

Next, a description will be given of the case where the pulse voltage of the waveform (b) in FIG. 7 is applied, as an example when the time of application of the reset signal is varied. The graph of FIG. 9 shows the Y value versus the applied voltage for select signal voltages Vs of 70 V to 100 V. Open squares are for those whose initial state was the focal conic state, and solid squares are for those whose initial state was the planar state. In FIG. 9, the difference between the Y values for the same applied voltage, due to the difference in the initial state, is larger than in the case of FIG. 8, which means that it is difficult to display four or more gray scale levels. From the results shown in FIGS. 8 and 9, it can be seen that as t1 is made longer, the liquid crystal becomes less sensitive to its state before updating, and if t1 is made sufficiently long, the liquid crystal can be updated to the desired display state regardless of its state before updating. That is, by applying the reset signal for a sufficiently long period of time, the influence of the previous state can be eliminated. The waveform (a) has shown the reset signal of 200 ms duration, achieving four or so gray scale levels; if the reset signal is applied for more than 200 ms, the difference in the selected display state, due to the difference in the initial state, is eliminated, and reproduction of four or more gray scale levels becomes possible.

Second Embodiment

Figure 10:
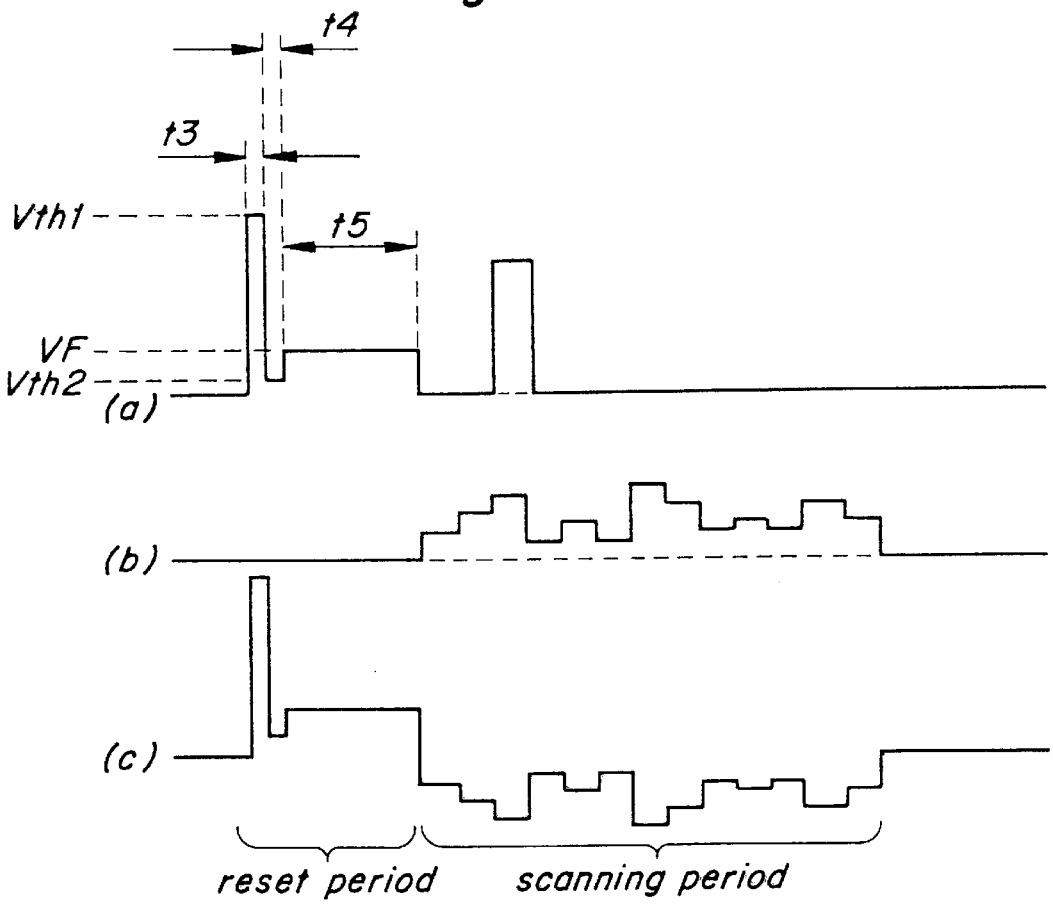
FIG. 10 is a chart diagram showing voltage waveforms used in a second embodiment.

A second embodiment will be described next. In this embodiment, pulse voltages of the waveforms shown in FIG. 10 are used. The waveform (a) is the voltage waveform applied to the scanning electrode R3, the waveform (b) is the voltage waveform applied to the signal electrode C1, and the waveform (c) is the voltage waveform applied to the liquid crystal forming the pixel LC3-1 located at the intersection of the scanning electrode R3 and signal electrode C1. The difference from the voltage waveforms shown in FIG. 5 lies in the reset signal applied during the reset period, while the signal applied to the signal electrode C1, shown by the waveform (b), is exactly the same.

In the waveform (c), during the reset period, a voltage Vth1 for setting the liquid crystal into the homeotropic state is first applied for a duration of time t3, and then the voltage is held below a threshold voltage Vth2 for a duration of time t4 for setting the liquid crystal into the planar state. After that, to cause the liquid crystal in the planar state to change to the focal conic state, a voltage greater than Vth2 and smaller than Vth1, that is, a voltage VF in this example, is applied for a duration of time t5, thereby resetting all the pixels to the focal conic state. The signals applied during the subsequent scanning period are exactly the same as those applied in the method of the foregoing first embodiment.

In the second embodiment, the reset period consists of t3+t4+t5, which is compared with t1 in the method of the first embodiment. In the method of the second embodiment, since the influence of the previous display state can be eliminated by once setting the liquid crystal into the homeotropic state, the entire reset period, t3+t4+t5, can be made shorter than t1. This achieves faster updating of the entire screen. Though it depends on the number of gray scale levels required, cell structure, etc., t5 can be set, for example, within the range of about 10 ms to 1s.

The configuration in which after once setting the liquid crystal into the homeotropic state during the reset period, the liquid crystal is reset to the focal conic state through the planar state, as described in the second embodiment, can also be applied to the third to 10th embodiments hereinafter described.

EXAMPLE 2

Figure 11:
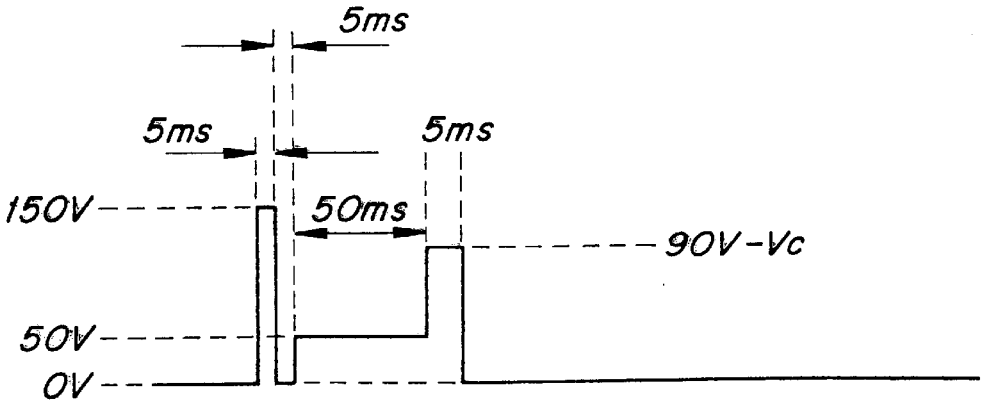
FIG. 11 is a chart diagram showing a voltage waveform used in Example 2.
Figure 12:
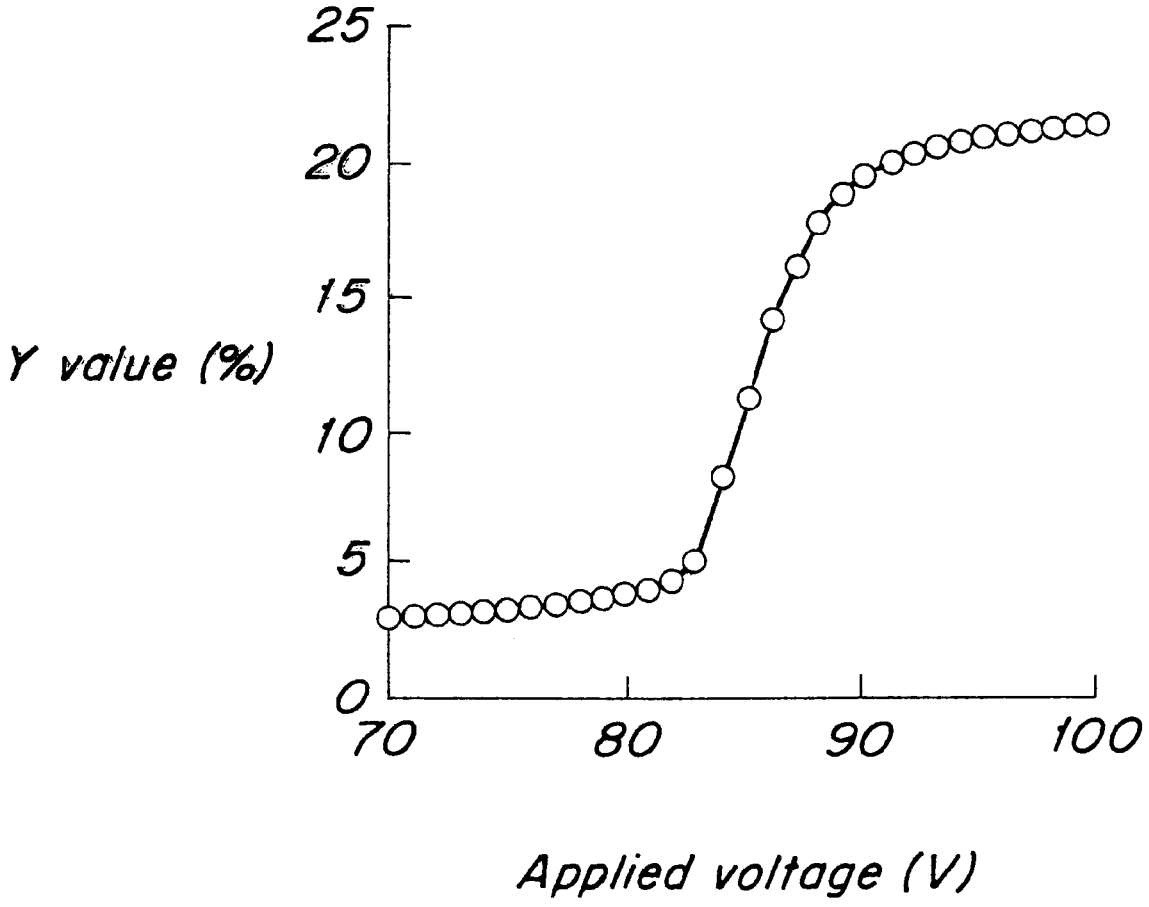
FIG. 12 is a graph showing the Y values obtained in Example 2.

The pulse voltage of the waveform shown in FIG. 11 was applied to the liquid crystal in the test cell. Only one pixel was chosen for testing, and only the select signal was applied during the scanning period. Vth1 was set at 150 V, Vth2 at 0 V, t2 at 5 ms, t3 at 5 ms, t4 at 5 ms, t5 at 50 ms, VF at 50 V, and Vr at 90 V. The graph of FIG. 12 shows the Y value versus the applied voltage for select signal voltages Vs of 70 V to 100 V. Open circles are for those whose initial state was the focal conic state, and solid circles are for those whose initial state was the planar state. As shown, most of the solid circles are hidden behind the open circles, which means that the difference in the display state due to the difference in the initial state is completely eliminated. Further, resetting to the focal conic state can be accomplished in a shorter time than in the case of Example 1.

Third Embodiment

Figure 13:
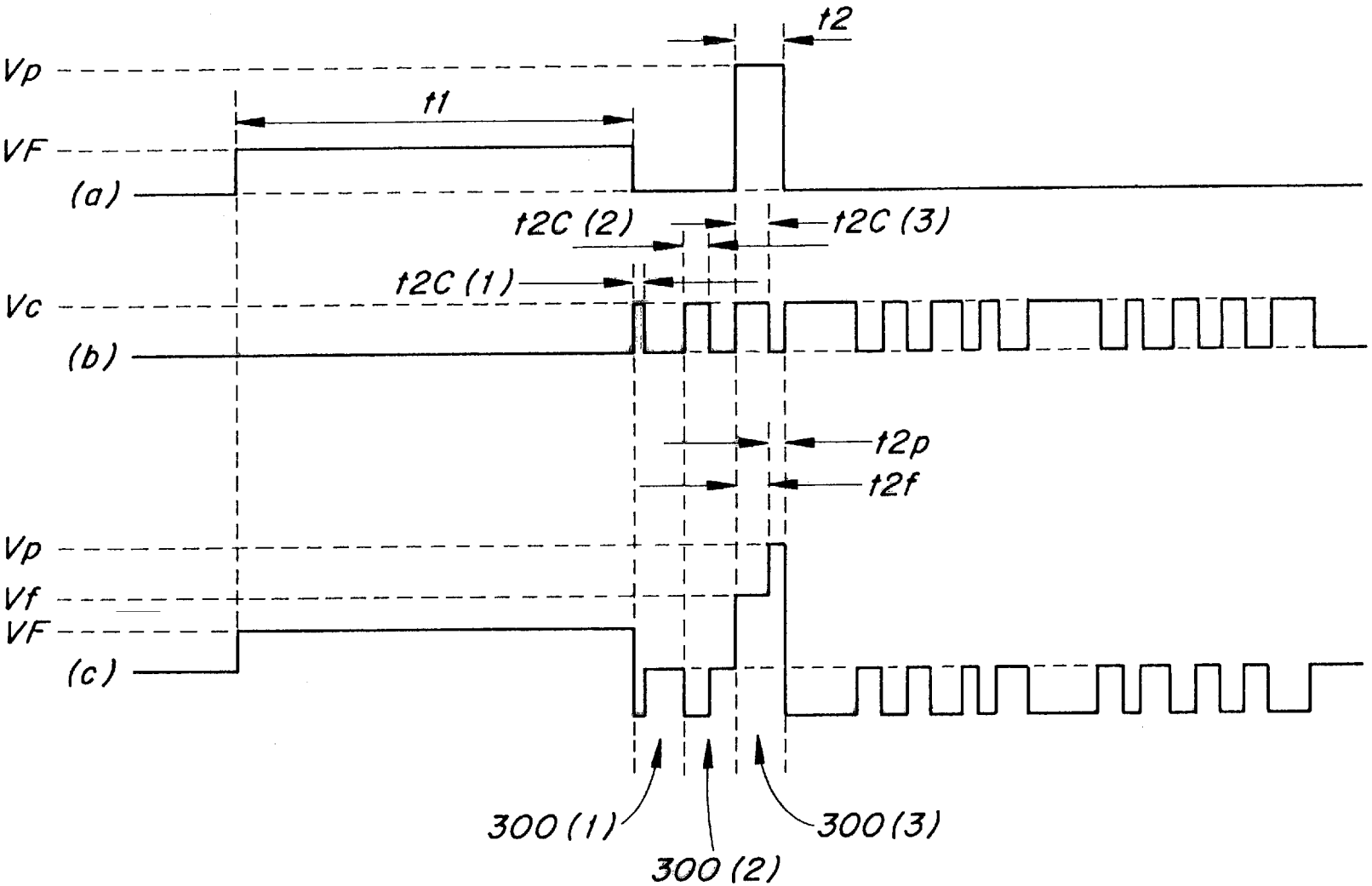
FIG. 13 is a chart diagram showing voltage waveforms used in a third embodiment.

A third embodiment will be described next. In this embodiment, pulse voltages of the waveforms shown in FIG. 13 are used. The waveform (a) is the voltage waveform applied to the scanning electrode R3, the waveform (b) is the voltage waveform applied to the signal electrode C1, and the waveform (c) is the voltage waveform applied to the liquid crystal forming the pixel LC3-1 located at the intersection of the scanning electrode R3 and signal electrode C1. In the waveform (a), the scan reset signal has a voltage VF and a pulse width t1. The scan select signal has a voltage Vp and a pulse width t2. In the waveform (b), the data signals have a constant voltage Vc but the pulse width is varied for each scanning electrode select period, the pulse width being t2c(i) in period 300(i) (i is an integer between 1 and m).

The difference from the voltage waveforms shown in FIG. 5 lies in the waveform of the select signal. In FIG. 5, the select signal was held at a constant pulse width and its voltage was varied to select the display state showing the desired Y value. In the third embodiment, the desired reflectivity is selected by applying a select pulse in which the ratio of time t2p to time t2f in the select period is varied, where the time t2p is the time during which the voltage Vp for selecting the planar state is applied, and the time t2f is the time during which the voltage, Vf=Vp−Vc, for selecting the focal conic state is applied. To achieve this, the pulse width of the data signal applied from the signal electrode is varied. The pulse width of the data signal applied to the signal electrode during the select period 300(3) of the scanning electrode R3 is t2c(3). Accordingly, the time t2p during which the voltage Vp for selecting the planar state is applied is t2p=t2−t2c(3); thus, when the scan select signal and the data signal are of the same polarity, the application time t2p becomes shorter as the pulse width of the data signal is increased.

In the first embodiment, multi-value voltages become necessary for gray scale reproduction, and ICs that can output such multiple voltage values are needed for driving. Generally, CMOS circuits are incorporated in the output circuitry of a driver IC, and to output multi-value voltages, it becomes necessary to provide a plurality of high voltage withstanding CMOS circuits for each output terminal. On the other hand, in the third embodiment, since gray scale reproduction becomes possible by only controlling the pulse width, an inexpensive two-value output type digital IC can be used that needs only one high voltage withstanding CMOS circuit for each output terminal. This offers a cost advantage over the method of the first embodiment.

EXAMPLE 3

Figure 14:
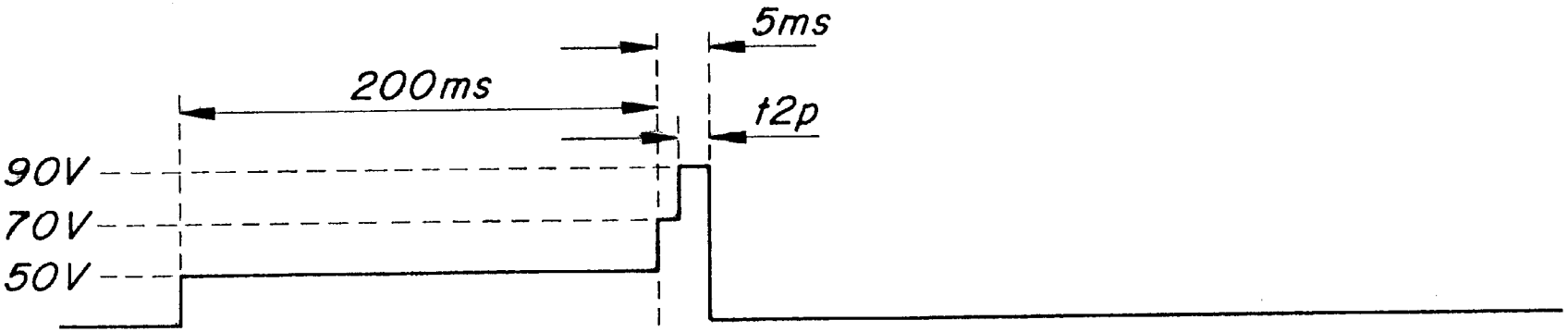
FIG. 14 is a chart diagram showing a voltage waveform used in Example 3.
Figure 15:
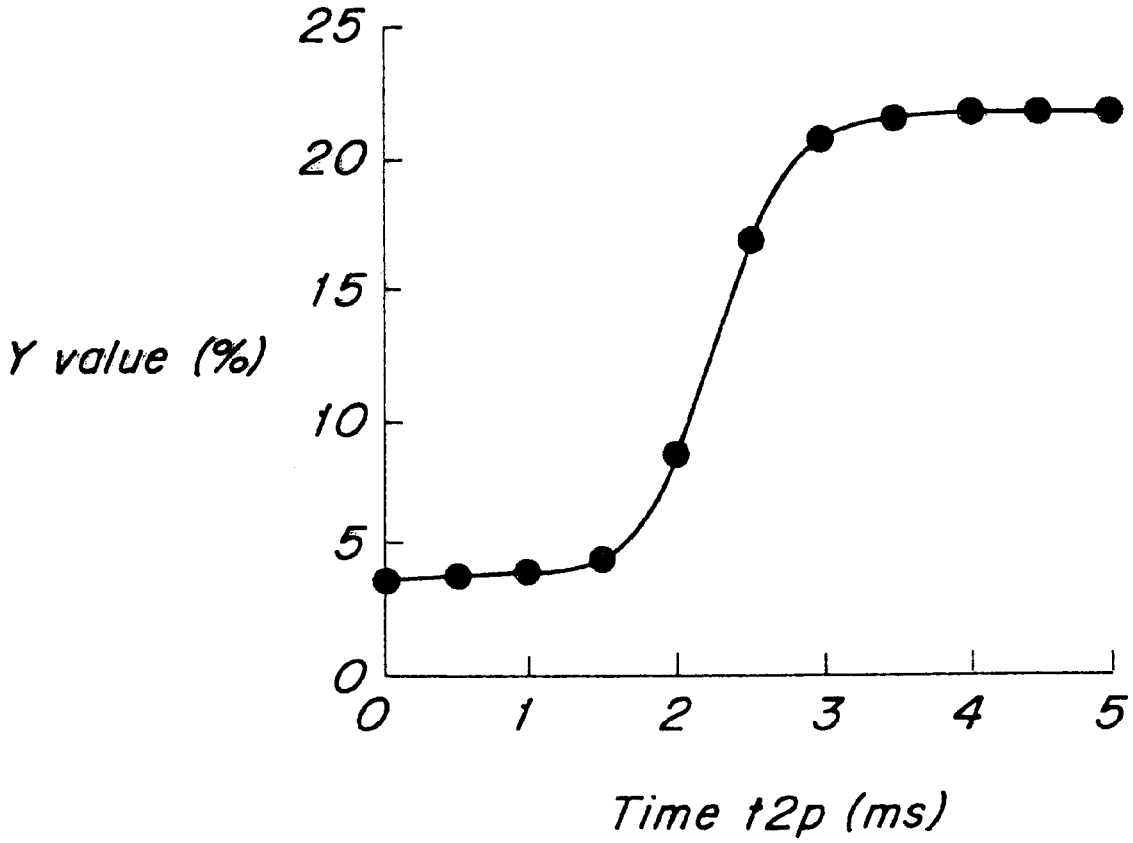
FIG. 15 is a graph showing the Y values obtained in Example 3.

The pulse voltage of the waveform shown in FIG. 14 was applied to the liquid crystal in the test cell. Only one pixel was chosen for testing, and only the select signal was applied during the scanning period. The voltage setting in the reset period is the same as that in Example 1; that is, VF=50 V and t1=200 ms. The voltage setting in the select period is: t2=5 ms, Vp=90 V, and Vf=70 V. The Vp application time t2p was varied, assuming the case in which the pulse width of the data signal was varied. The relationship between the application time t2p and the Y value is shown by the graph in FIG. 15. As shown, the Y value varies continuously with time t2p, the Y value increasing with increasing time t2p. This shows that the display state showing the desired Y value can be selected by controlling the pulse width of the data signal.

Fourth Embodiment

In any of the methods of the foregoing first to third embodiments, after the display state of a liquid crystal is selected by a select signal, the data signal being applied to the liquid crystal forming pixels on another scanning electrode is applied to the former liquid crystal. This data signal is applied to that former liquid crystal as a deselect signal (hereinafter referred to as a cross talk signal). The liquid crystal to be driven by the fourth embodiment has a memory characteristic whereby the display state, once selected, is retained even if a voltage smaller than a certain threshold voltage is thereafter applied to it. Therefore, as long as the voltage Vct of the cross talk signal is smaller than that threshold, ideally the selected display state of the liquid crystal is retained and is not affected by the cross talk signal. In reality, however, when the low cross talk signal voltage Vct is applied as the deselect signal, the orientation of the liquid crystal slowly changes, causing a change in the display state. This results in reduced contrast since such a cross talk signal works to reduce the Y value, particularly in the planar state. Accordingly, it is preferable that the voltage Vct of the cross talk signal is made as small as possible.

Figure 16:
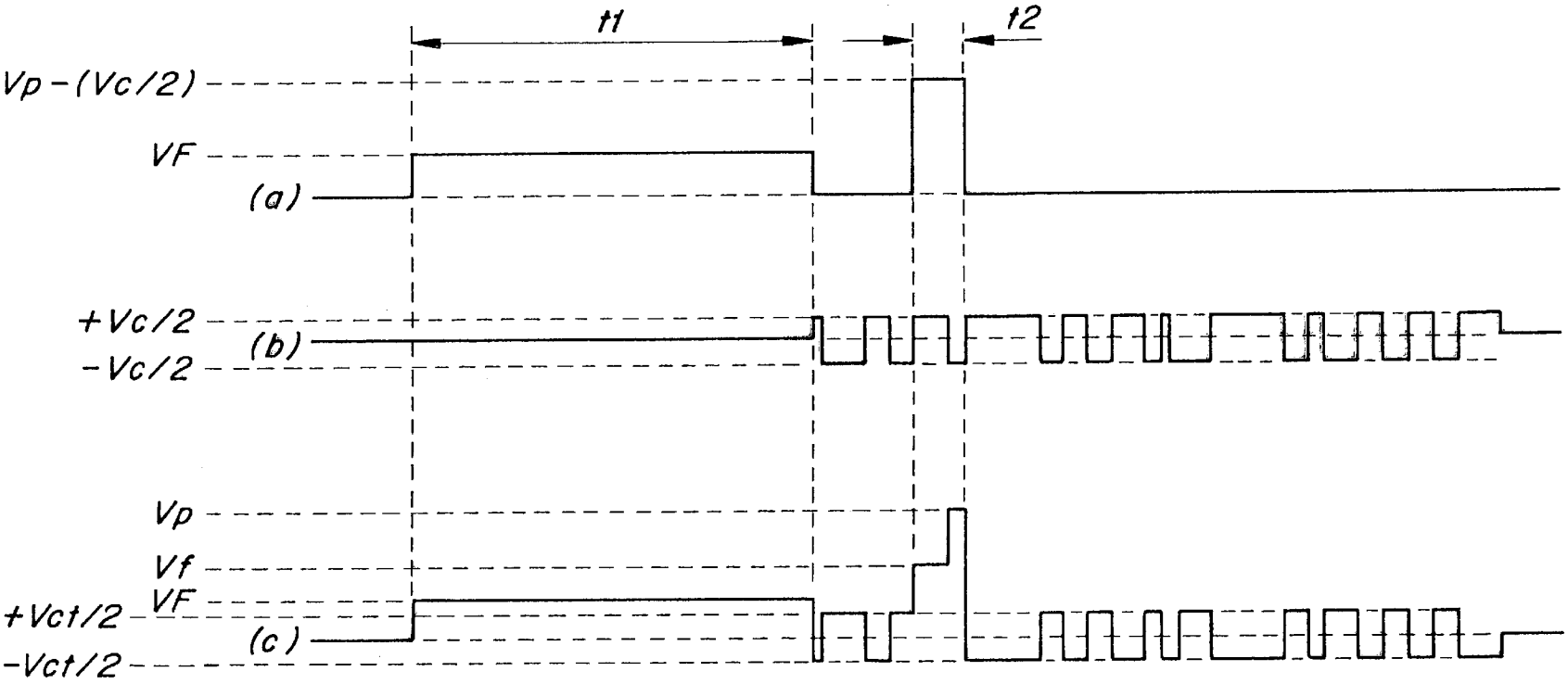
FIG. 16 is a chart diagram showing voltage waveforms used in a fourth embodiment.

The voltage waveforms used in the fourth embodiment are shown in FIG. 16. The waveform (a) is the voltage waveform applied to the scanning electrode R3, the waveform (b) is the voltage waveform applied to the signal electrode C1, and the waveform (c) is the voltage waveform applied to the liquid crystal forming the pixel LC3-1 located at the intersection of the scanning electrode R3 and signal electrode C1. In the waveform (a), the scan reset signal has a voltage VF and a pulse width t1, and the scan select signal has a voltage, Vp−(Vc/2), and a pulse width t2. The waveform (b) has both the positive and negative polarities, and the absolute value of the voltages is Vc/2, i.e., one half of the waveform (b) shown in FIG. 13.

During the application period of the voltage Vp in the select period, the data signal applies a voltage that is opposite in polarity to the scan select signal, and during the application period of the voltage Vf, the data signal applies a voltage that is identical in polarity to the scan signal. By applying such a data signal, the ratio of the application time of the voltage Vp to the application time of the voltage Vf=Vp−Vc in the select period can be varied, and the state having the desired Y value can be selected, as in the method of the third embodiment.

While the absolute voltage value of the cross talk signal was Vc in the foregoing third embodiment, in the fourth embodiment it is reduced to Vc/2, a reduction by a factor of 2 compared with the method of the third embodiment. Since the response of the liquid crystal driven by the fourth embodiment does not depend on the voltage polarity, the voltage of the cross talk is, in effect, reduced by one half. This avoids reducing the Y value in the planar state, and thus contributes to improving the contrast.

In the fourth embodiment, voltages opposite in polarity but equal in magnitude are constantly applied to the liquid crystal layer during the deselect period. Therefore, compared with the third embodiment in which cross talk signal voltages identical in polarity but different in width are applied during the deselect period because of data for other pixels, the so-called shadowing in which the display state changes because of the difference in image data is less likely to occur.

In the fourth embodiment, positive and negative voltages equal in magnitude are applied alternately as the data signals, but if positive and negative voltages not equal in magnitude are applied, the cross talk voltage can, in effect, be reduced, compared with the third embodiment in which voltages of a single polarity are applied. From this point of view, even in cases where the gray scale is reproduced by varying the voltage value, as in the first and second embodiments, the cross talk voltage can, in effect, be reduced by shifting at least either one of the data signal and scan signal in such a manner that the cross talk voltage applied to the liquid crystal changes between positive and negative across zero.

EXAMPLE 4

Figure 17:
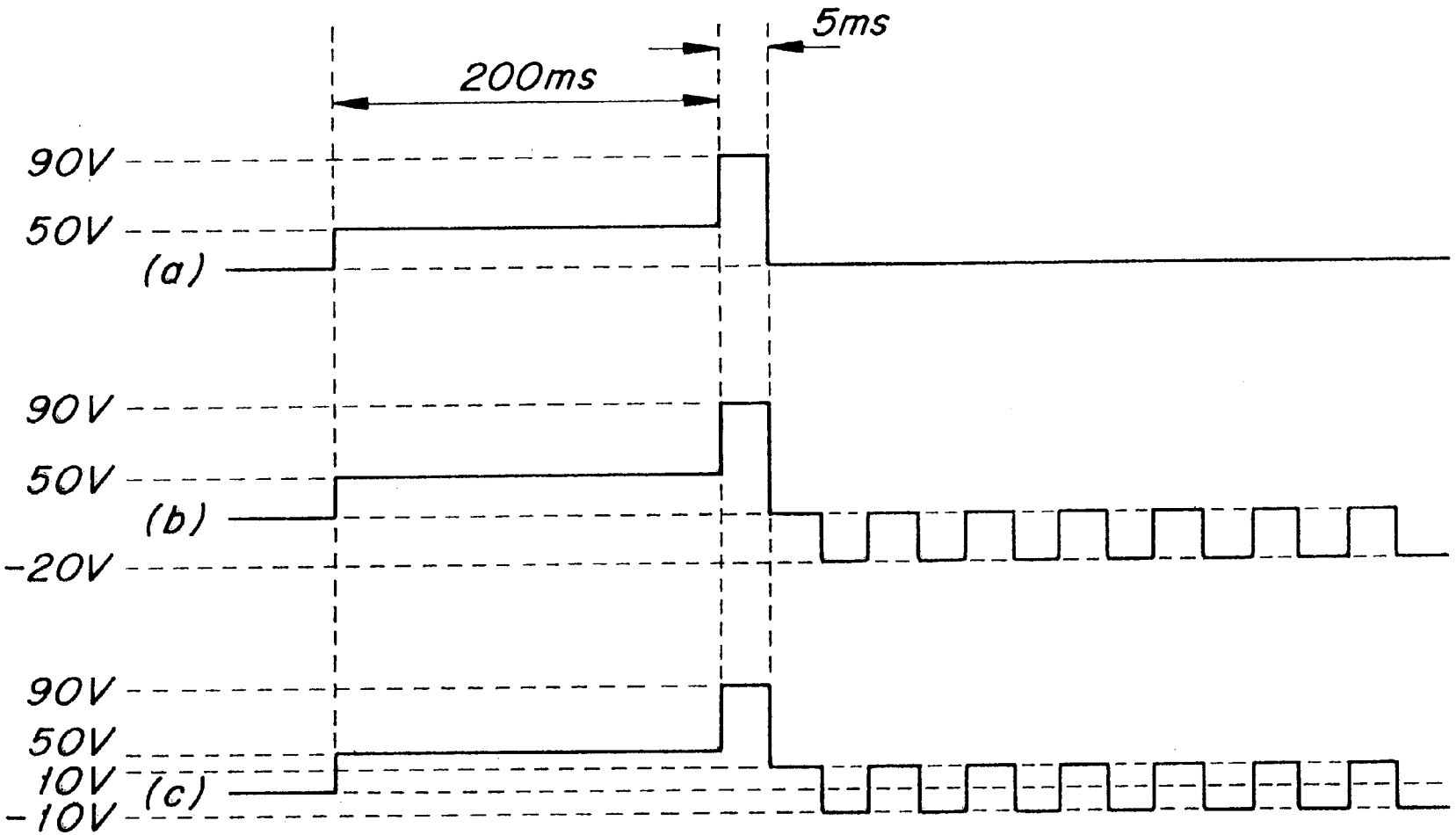
FIG. 17 is a chart diagram showing voltage waveforms used in Example 4.

Waveforms (a), (b), and (c) shown in FIG. 17 were applied to the liquid crystal in the test cell. The reset signal and the select signal were the same as those used in Example 3; that is, VF=50 V, t1=200 ms, Vp=90 V, Vf=70 V, and t2=5 ms.

The waveform (a) shown in FIG. 17 is one that does not consider cross talk signals, and is used to write the planar state exhibiting the highest Y value. The waveform (b) shown in FIG. 17 is one that considers cross talk according to the method corresponding to the third embodiment. Here, the number of scanning electrodes, m=1000, was assumed, and cross talk signals corresponding to 1000 lines were applied. The voltage Vct of the cross talk signal in this case is 20 V. In this method, the cross talk signal varies depending on the image data to write; therefore, as an example, we considered the case where the planar state showing the highest Y value was written to the first line and intermediate image data was written to all of the other pixels. The waveform (c) shown in FIG. 17 is the waveform according to the method of the fourth embodiment; compared with the waveform (b), the voltage Vct/2 of the cross talk signal is reduce by one half to ±10 V. Here, the number of scanning electrodes, m=1000, was assumed, as in the case of the waveform (b), and cross talk signals Vct/2 corresponding to 1000 lines were applied.

As for the Y value of the visual reflectivity, when the waveform (a) of FIG. 17 was applied, the Y value was 21.79. When the waveform (b) of FIG. 17 was applied, the Y value was 12.68. When the waveform (c) of FIG. 17 was applied, the Y value was 19.99.

With the waveform (b), the Y value decreases compared with the case of the waveform (a). This shows that the Y value at the time of the selection of the planar state decreases because of the influence of the cross talk signals. With the waveform (c) also, the Y value decreases slightly compared with the case of the waveform (a), but when the waveforms (b) and (c) are compared, the Y value is larger and the influence of the cross talk signals is reduced with the method of the fourth embodiment compared with the method corresponding to the third embodiment. Accordingly, the method of the fourth embodiment offers an advantage in terms of the contrast.

Fifth Embodiment

Figure 18:
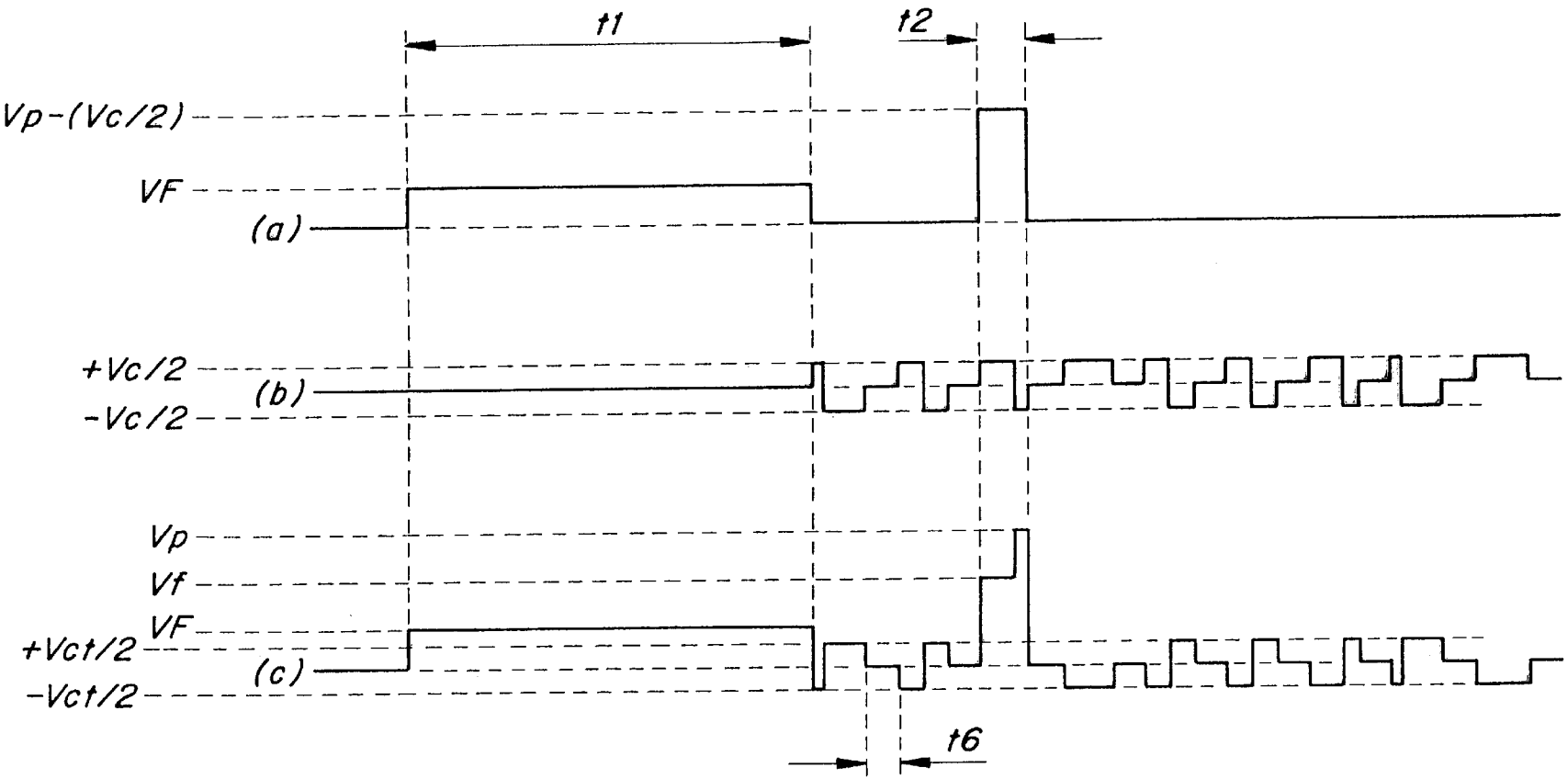
FIG. 18 is a chart diagram showing voltage waveforms used in a fifth embodiment.

Voltage waveforms used in the fifth embodiment are shown in FIG. 18. The waveform (a) is the voltage waveform applied to the scanning electrode R3, the waveform (b) is the voltage waveform applied to the signal electrode C1, and the waveform (c) is the voltage waveform applied to the pixel LC3-1 located at the intersection of the scanning electrode R3 and signal electrode C1. In the waveform (a), the scan reset signal has a voltage VF and a pulse width t1, and the scan select signal has a voltage, Vp−(Vc/2), and a pulse width t2. In the waveform (b), the absolute value of the data signals is Vc/2, as in the case of the fourth embodiment. This is to vary the time ratio of the positive voltage to the negative voltage applied during the select period of each scanning electrode. The resulting voltages applied to the liquid crystal are as shown in the waveform (c), that is, the reset signal has the voltage VF and pulse width t1 and the select signal has the pulse width t2 with varying time ratio of the voltage Vp to the voltage Vf=Vp−Vc. This makes gray scale reproduction possible, as in the method of the fourth embodiment.

The difference from the method of the fourth embodiment is that the successive data signals are each separated by a quiescent period t6. As for the signals applied to the scanning electrode, a quiescent period t6 is interposed between the scan select signal and the scan deselect signal, and each successive scan deselect signal is also separated by a quiescent period t6. As a result, during the quiescent periods, no voltage is applied to the liquid crystal. In the method of the fourth embodiment, since cross talk signals are applied continuously, the orientation of the liquid crystal changes slowly, which, depending on cases, has led to the possibility of the display state gradually departing from the selected state. However, when quiescent periods t6 are interspersed, as in the fifth embodiment, cross talk signals are applied in a pulsed form. As a result, if the orientation of the liquid crystal changes due to a cross talk signal, since the liquid crystal is relaxed back to the original state during the succeeding quiescent period, the influence of the cross talk signal can be reduced.

The driving waveforms in which the data signals and the signals applied to the scanning electrode are provided with the quiescent periods, as described in the fifth embodiment, can also be applied to the configuration in which cross talk signals only of the same polarity are applied, as in the third embodiment, as well as to the configuration in which the gray scale is reproduced by varying the voltage value, as described in the first and second embodiments.

EXAMPLE 5

Figure 19:
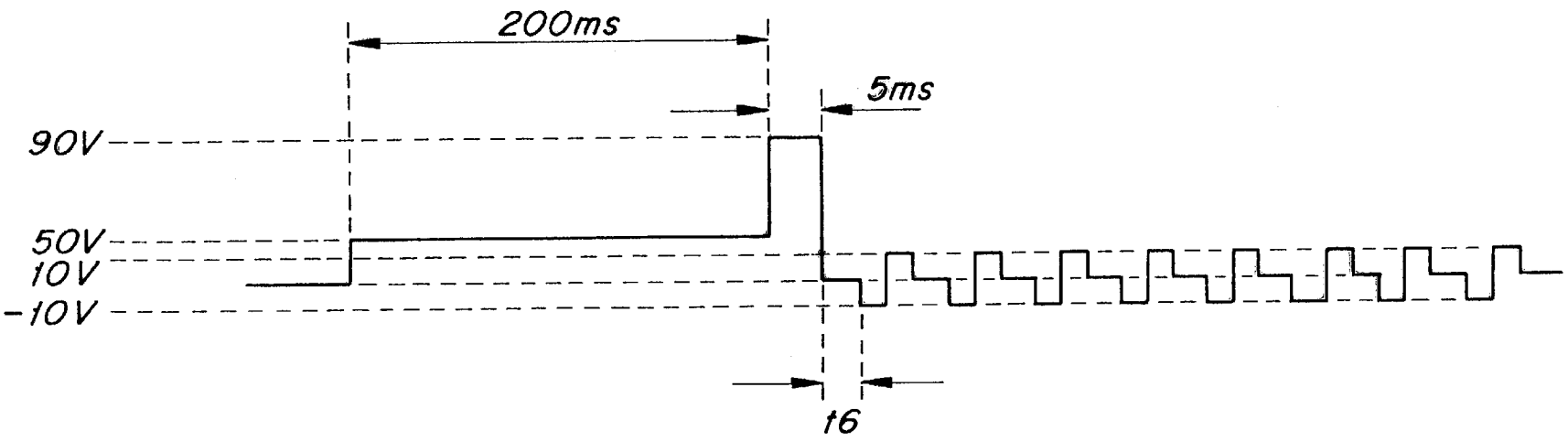
FIG. 19 is a chart diagram showing a voltage waveform used in Example 5.

The pulse voltage of the waveform shown in FIG. 19 was applied to the liquid crystal in the test cell. Here, t1 was set at 200 ms, Vp at 90 V, t2 at 5 ms, and Vct at ±10 V. The number of scanning electrodes, m=1000, was assumed, and cross talk signals corresponding to 1000 lines were applied. The liquid crystal was set in the planar state by the select signal, and after a quiescent period t6, the cross talk signals were applied. Each cross talk signal is also separated by a quiescent period t6. The Y value was measured by varying the quiescent period t6 between 0 ms to 10 ms; the results are shown in FIG. 20. As shown, the Y value at the time of the selection of the planar state increases as the quiescent period t6 is made longer. That is, when the method of the fifth embodiment is used, the influence of the cross talk signals can be reduced.

Sixth Embodiment

In the driving method of the first embodiment, when the liquid crystal forming each pixel on the scanning electrode R1 for the first line is compared with the liquid crystal forming each pixel on the scanning electrode Rm for the m-th line which is the last line, the time interval from the reset period to the select period of the scanning electrode RI is different from the time interval from the reset period to the select period of the scanning electrode Rm. In the memory state of the liquid crystal device, the liquid crystal slowly orients itself with respect to the substrate surfaces, and it takes time until the orientation of the liquid crystal stabilizes after the applied voltage is turned off. Therefore, strictly speaking, the liquid crystal state immediately before the select period is slightly different between the liquid crystal on the first line and the liquid crystal on the m-th line. As a result, a slight difference occurs in the Y value if the same select signal is applied for each scanning electrode, and uneven density may result, especially when displaying intermediate tones. This is presumably because the liquid crystal state immediately before the select period of the scanning electrode Rm is closer to the perfect focal conic state than the liquid crystal state immediately before the select period of the scanning electrode R1 is, so that if the same select signal is applied, a display state with a smaller Y value is selected.

To eliminate this density unevenness, in the sixth embodiment, the relationship between the pulse width of the select signal and the Y value is measured in advance for each scanning electrode, and image data is converted so that a select signal of a different pulse width is applied for each scanning electrode. Stated more specifically, the image data is converted so that a select signal with a longer Vp application time t2p than that in the select period of the scanning electrode R1 is applied in the select period of the scanning electrode Rm.

FIG. 21 shows the drive circuits capable of converting image data used in the sixth embodiment. A scan driver IC 200 and a signal driver IC 201 are connected to the liquid crystal device 100; these ICs 200 and 201 are driven by control signals from scan controllers 202 and a signal controller 203, respectively. Image data to be displayed is input to the signal controller 203, but before that, the data is converted into the select signal by an image data converting section 204.

Figure 22:
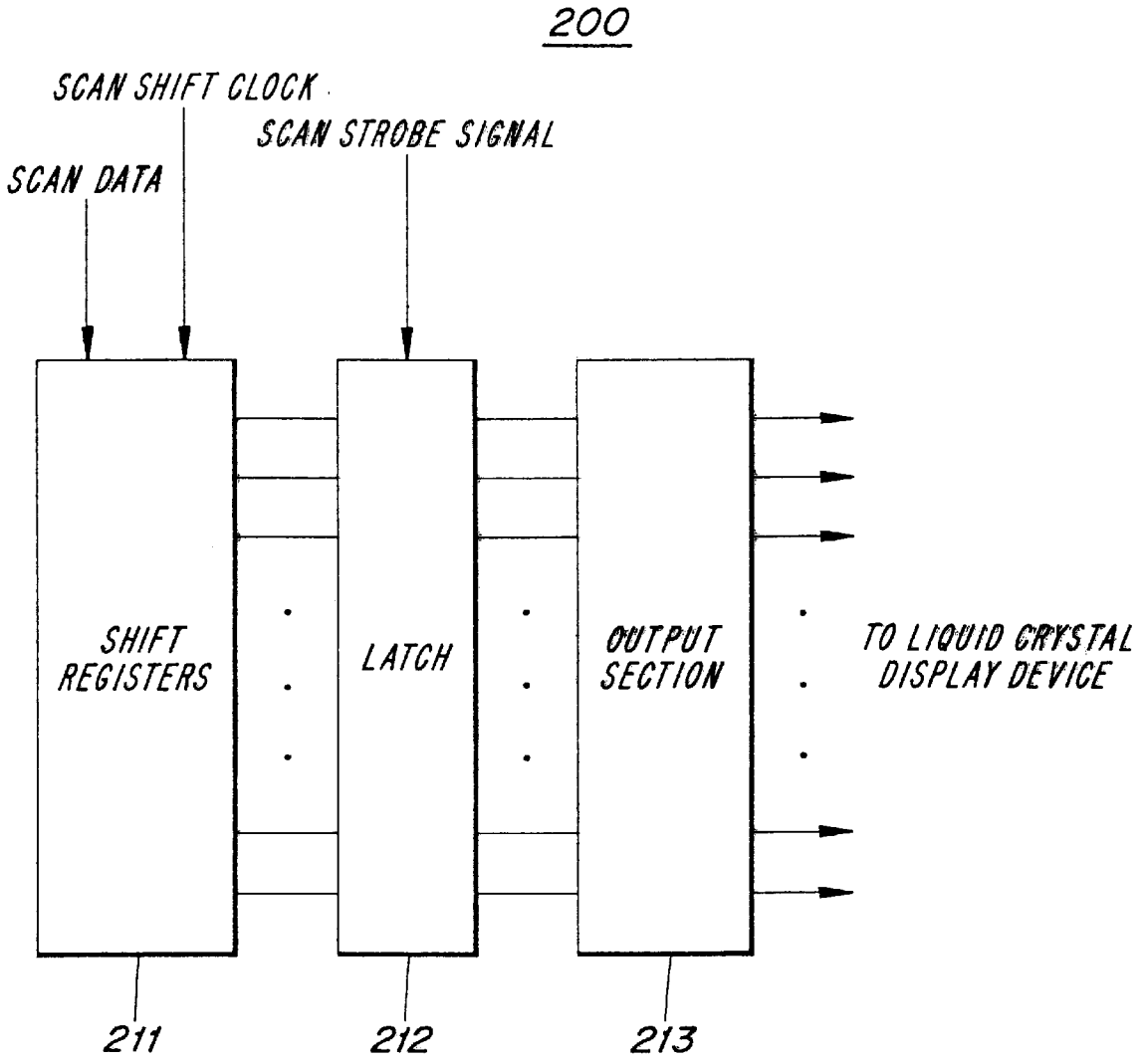
FIG. 22 is a block diagram of a scan driver IC.

FIG. 22 shows the configuration of the scan driver IC 200. The scan driver IC 200 comprises shift registers 211, latches 212, and an output section 213 containing output CMOS circuits. Control signals consist of scan data and a scan shift clock, which are input to the shift register 211, and a scan strobe signal which is input to the latch 212; these control signals are input from the scan controller 202. The shift registers 211 are an array of m shift registers corresponding to the number of scanning electrodes, and perform shift operations by the application of the scan shift clocks. The latches 212 are an array of m latches, and hold each output of the shift registers 211 for one select period by the scan strobe signal.

Figure 23:
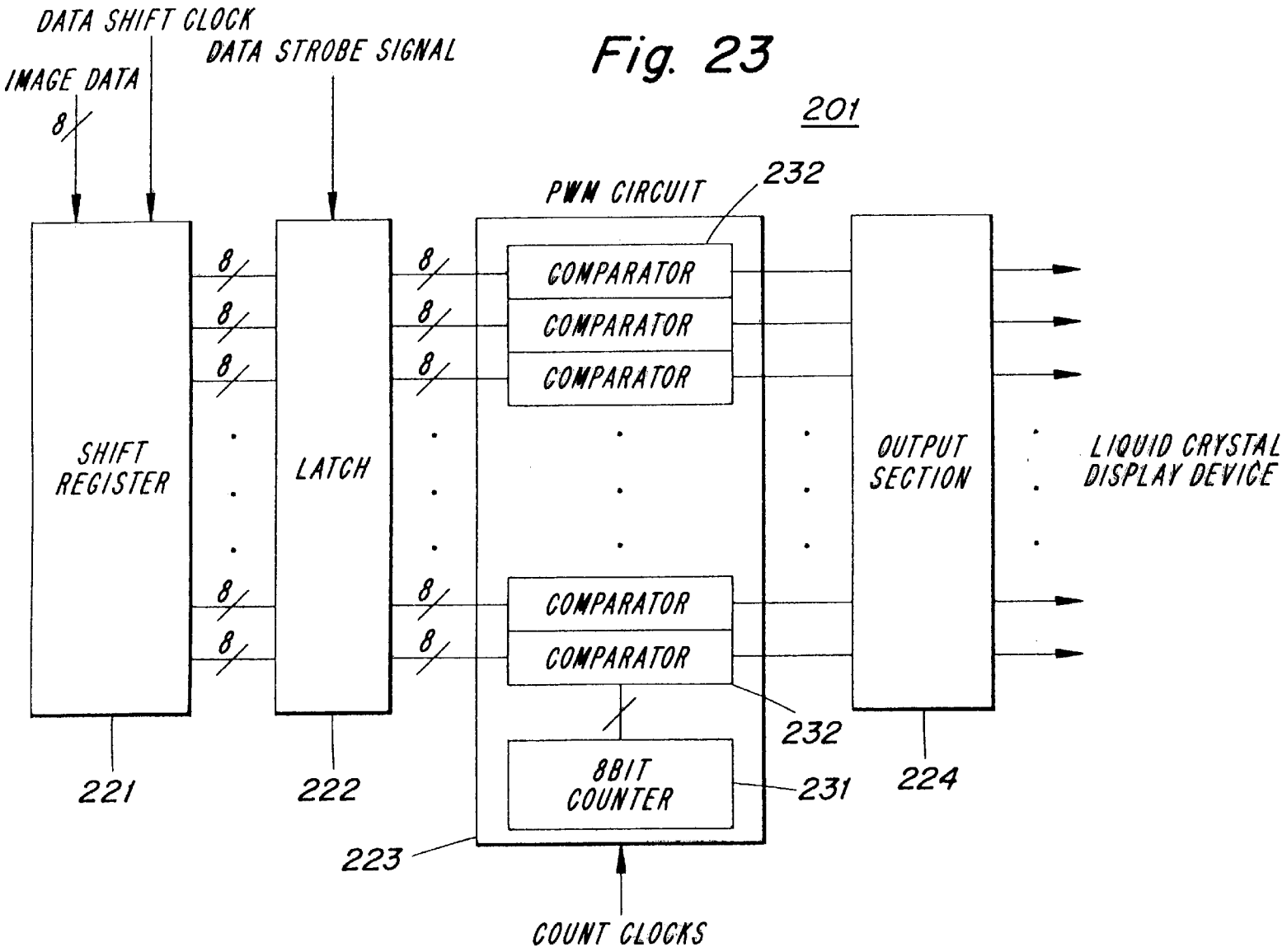
FIG. 23 is a block diagram of a signal driver IC.

FIG. 23 shows the configuration of the signal driver IC 201. The example of the signal drive circuit 201 shown here is equipped with a pulse width modulation circuit (PWM circuit) 223 capable of varying the pulse width for reproduction of 256 gray scale levels. The signal driver IC 201 comprises shift registers 221, latches 222, the PWM circuit 223, and an output section 224,containing output CMOS circuits. Control signals consist of image data and a data shift clock input to the shift register 221, a data strobe signal input to the latch 222, and a count clock input to an 8-bit counter 231 in the PWM circuit 223; these control signals are input from the signal controller 203. The image data consists of 8 bit to provide 256 gray scale levels, and is input to the shift register 221. The shift registers 221 are an array of n shift registers each with 8 bit, and perform shift operations by the application of the data shift clocks. The latches 222 are an array of n latches each with 8 bits, and hold the outputs of the shift registers 221 for one select period by the data strobe signal. The PWM circuit 223 consists of the 8-bit counter 231 and n comparators 232. The 8-bit outputs from the latches 222 are each compared with the output of the 8-bit counter 231, and when the two become equal, the output from the corresponding comparator 232 is switched.

Figure 24:
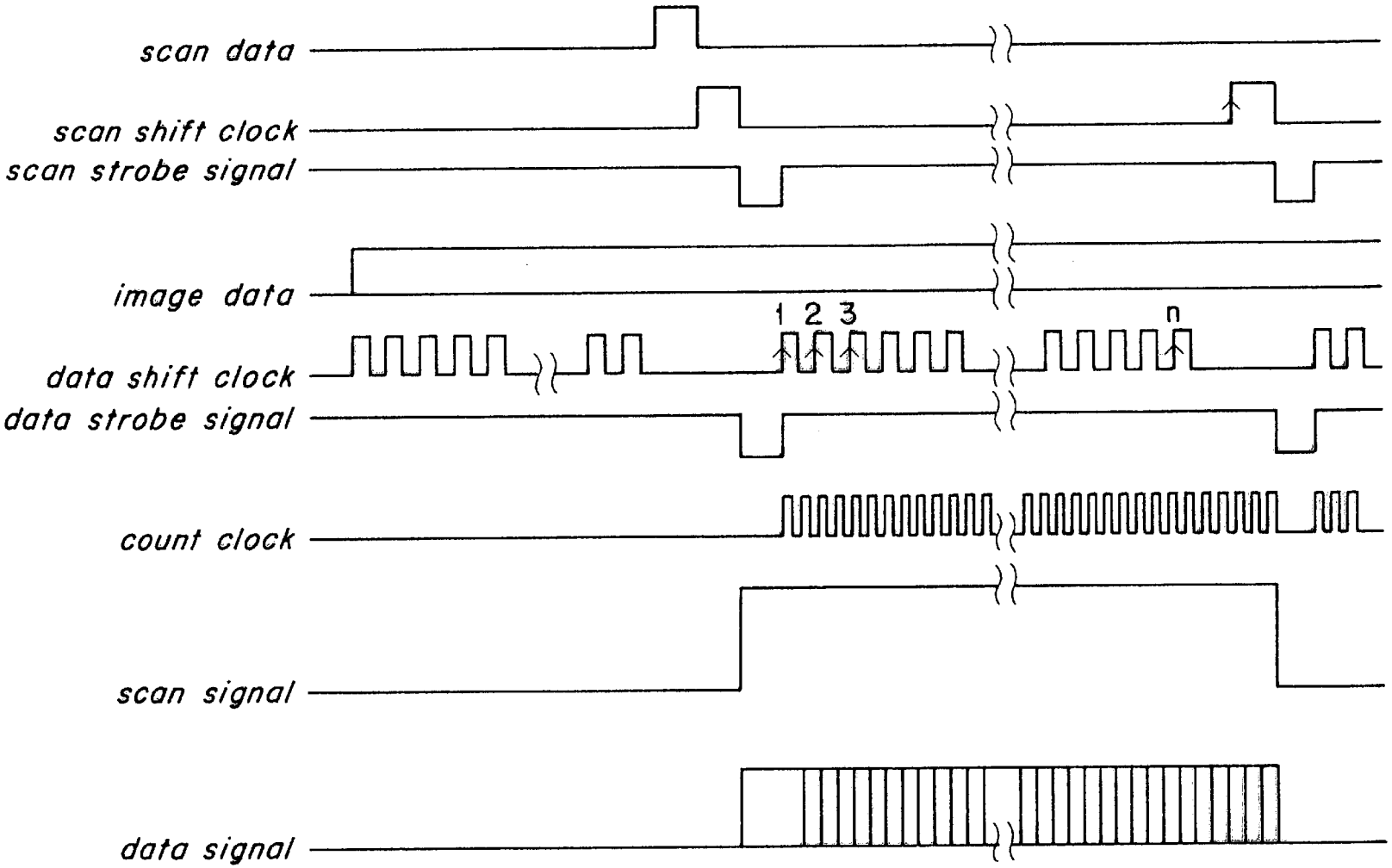
FIG. 24 is a chart diagram showing control signals used in a sixth embodiment.

FIG. 24 shows a timing chart for the respective control signals during the scanning period. Synchronously with the input of new update image data, n data shift clocks are input to operate the shift registers 221 in the signal driver IC 201. When the image data are loaded into the n 8-bit shift registers 221, the data strobe signal is input, causing the image data to be stored in the latches 222. At the same time, one scan data is input, and only the shift register 211 in the scan driver IC 200 corresponding to the first line is set on by the scan shift clock. Then, the scan strobe signal is input, and only the latch 212 in the scan driver IC 200 corresponding to the first line is set on. At this time, the select signal is applied to the scanning electrode for the first line, while zero voltages as the deselect signals are applied to the other electrodes. Next, after the time equal to the prescribed select signal width t2, the next scan shift clock is input, and only the shift register 211 in the scan driver IC 200 corresponding to the second line is set on. Then, the scan strobe signal is input, and only the latch 212 in the scan driver IC 200 corresponding to the second line is set on. At this time, the select signal is applied to the scanning electrode for the second line, while zero voltages as the deselect signals are applied to the other electrodes. By repeating this process, the scan signals can be output.

As for the signal electrodes, synchronously with the data strobe signal a counter clear signal is input to the 8-bit counter 231 in the PWM circuit 223 for initialization, and the output of each comparator is set on. Next, count clocks are input to the 8-bit counter 231 in the PWM circuit 223. With these count clocks, the output of the 8-bit counter 231 changes from 1 to 2 to 3, . . . , to 256. The output value of each of the n latches 222 corresponding to the respective signal electrodes is compared in the corresponding comparator 232 with the output value of the 8-bit counter 231, and at the instant that the output value of the latch 222 becomes smaller than the output value of the 8-bit counter 231, the output is set off. This off state is retained until the 8-bit counter 231 is cleared. In this way, the PWM modulated signals for the first line are output. While the PWM signals for the first line are being output, the image data for the second line is loaded into the shift registers 221 in the same manner as described above. At this time, the outputs of the latches 222 continue to hold the image data for the first line. When the data strobe signal and counter clear signal are input after the time equal to the prescribed select signal width t2, the value of the counter 231 is initialized to 0, and the outputs of the latches 222 are now held with the image data for the second line. After that, count clocks are input to the 8-bit counter 231 in the PWM circuit 223, to output the PWM signals for the second line. By repeating this process, the data signals as the PWM signals are output.

When the above operation is performed in the scanning period, as the value of the image data becomes smaller, the on period of the data signal as the PWM signal becomes shorter and, as a result, t2p in the select signal applied to the liquid crystal becomes longer. This means that by converting the image data into an arbitrary value by using the image data converting section 204, it becomes possible to vary t2p in the select signal applied to the liquid crystal, and thus to suppress the unevenness of density caused by the difference in the time from the reset period to the select period.

The configuration in which the pulse width of the select signal for each scanning electrode is varied by correcting the image data for each scanning electrode, as described in the sixth embodiment, can also be applied to the configuration in which the gray scale is reproduced by varying the pulse width of the data signal, as described in the third to fifth embodiments. The configuration can also be applied to the configuration in which the gray scale is reproduced by varying the voltage value, as described in the first and second embodiments, if the PWM circuit 223 is replaced with a pulse height modulation circuit (PHM circuit) and provisions are made to output the data signals that are corrected so that the select signal increases in magnitude as the scanning progresses from the first line toward the m-th line.

EXAMPLE 6

Figure 25:
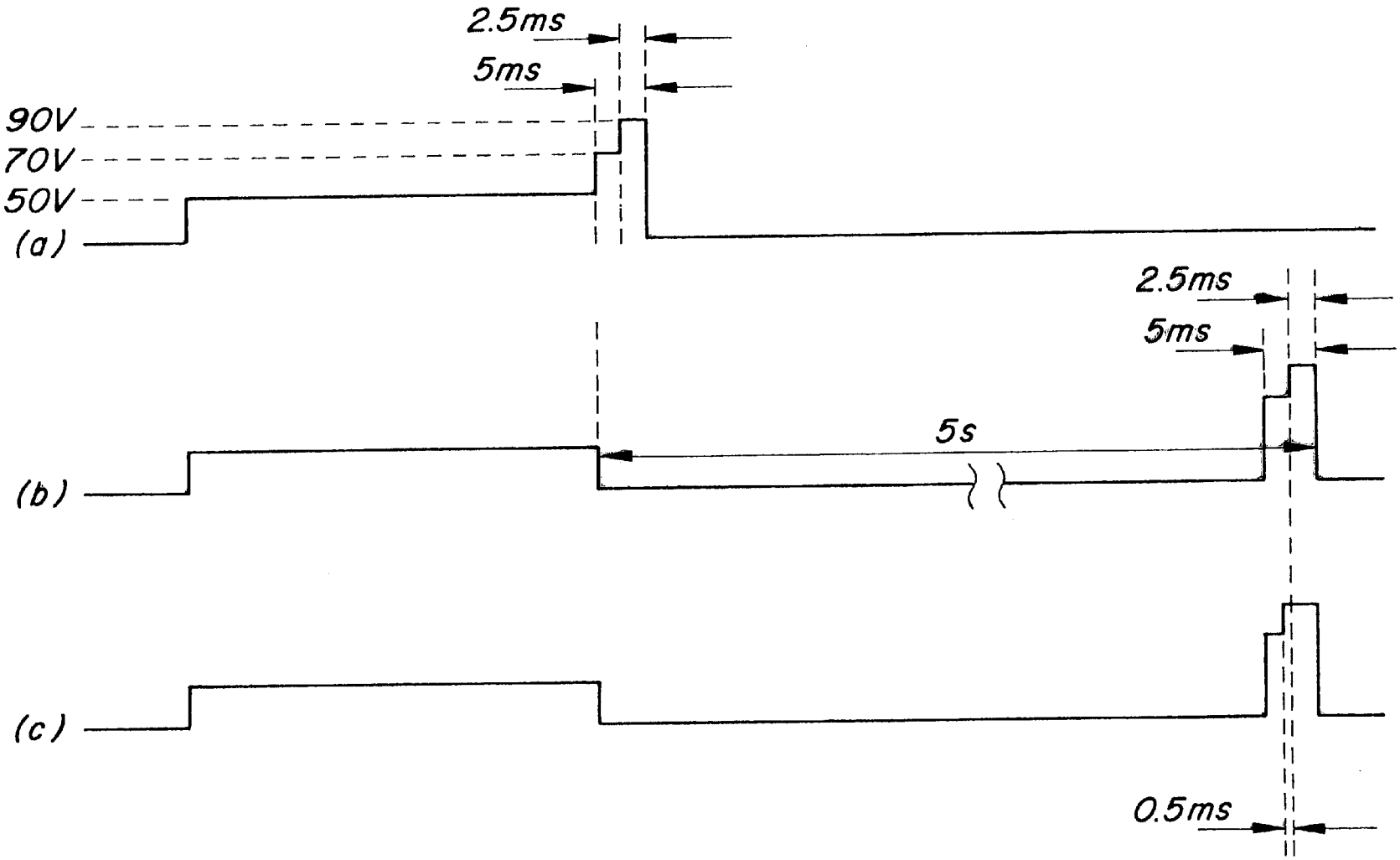
FIG. 25 is a chart diagram showing voltage waveforms used in Example 6.

The voltage pulses of the waveforms (a), (b), and (c) shown in FIG. 25 were applied to the liquid crystal in the test cell. The waveform (a) corresponds to the first line. The waveform (b) corresponds to the 1000th line, and shows an example in which a gray shade exactly at midpoint of the gray scale is displayed by inputting the image data corresponding to the 128th gray scale level. The waveform (c) corresponds to the 1000th line; in this case also, the image data corresponding to the 128th gray scale level is input, but a correction is applied according to the sixth embodiment. In the waveforms (a) and (b), the same select signal is used, the only difference being in the time interval from the reset period to the select period. In the waveforms (b) and (c), the same image data is input, but in the waveform (c), the image data is converted by the image data converting means 204. As a result, the Vp application time t2p in the select signal is 3.0 ms in the waveform (c), which is compared with 2.5 ms in the waveform (b).

Figure 26:
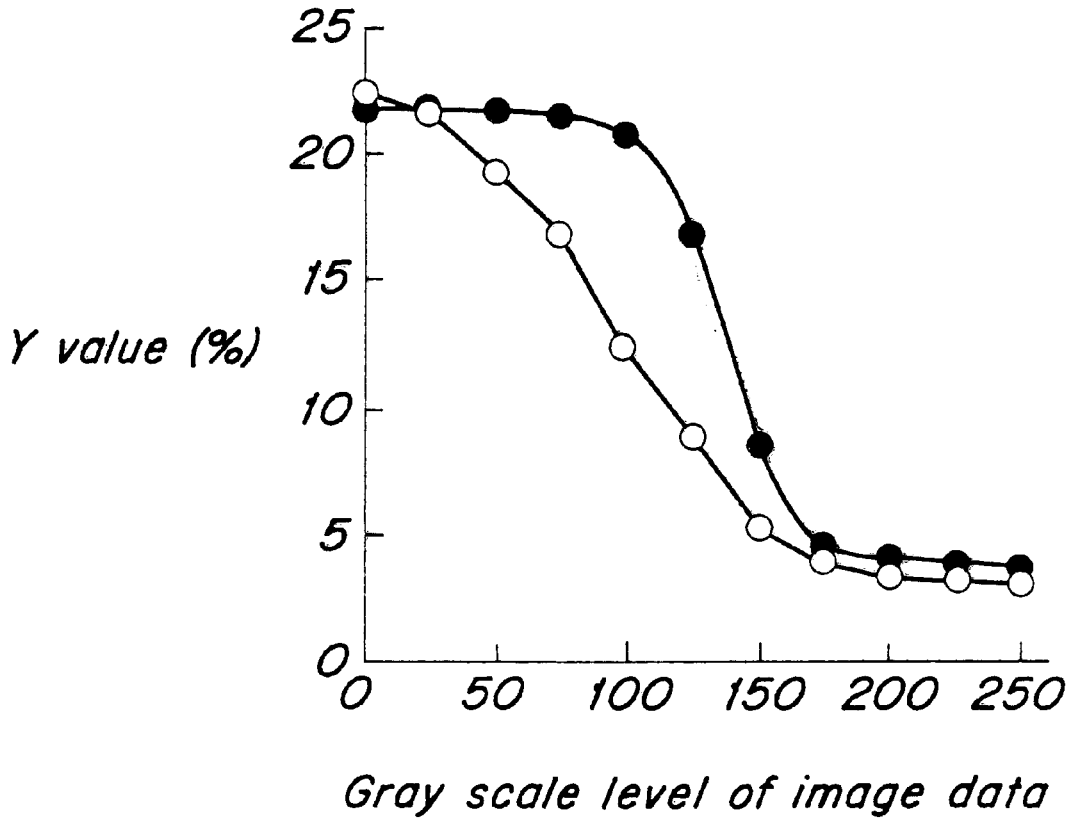
FIG. 26 is a graph showing the Y values obtained in Example 6.

FIG. 26 shows how the Y value changed when the image data was varied. Solid circles represent the results when the waveform (a) was applied, and open circles show the results when the waveform (b) was applied. A comparison between the solid circles and open circles show that a smaller Y value is selected for the 1000th line than for the 1st line for the input of the same image data. For example, for the image data corresponding to the 128th gray scale level, 16.84 is selected for the first line, while 8.92 is selected for the 1000th line.

In the method of the sixth embodiment, when converting the input image data to a smaller value by the image data converting means 204, if 128 is input as the image data value for the 1000th line, for example, the output value of the image data converting section 204 becomes 75. In that case, t2p is 3 ms. For the Y value, 16.78 is selected, which is approximately equal to the Y value for the first line. Further, when 150 is input as the image data value for the 1000th line, the output value of the image data converting section 204 becomes 120. In that case, t2p is 2.6 ms. For the Y value, 8.96 is selected, which is approximately equal to the Y value for the first line. By applying such corrections, it becomes possible to select the same Y value for the input of the same image data, thus making it possible to suppress the unevenness of density caused by the difference in the time interval from the reset period to the select period.

Seventh Embodiment

In the sixth embodiment, as can be seen from the results of Example 6, the application time t2p of the voltage Vp necessary to select the same Y value is made longer as the screen is scanned toward the last line, in order to prevent density unevenness from one scanning electrode to the next. Consequently, when the length of the select period is set identical for all the scanning lines, a select signal having a different t2p has to be applied for each scanning electrode. In the foregoing sixth embodiment, this is accomplished by converting the image data.

On the other hand, the seventh embodiment employs the following method by noting the fact that a select signal having a different t2p should be applied for each scanning electrode, to correct the density unevenness from one scanning electrode to the next.

Figure 27:
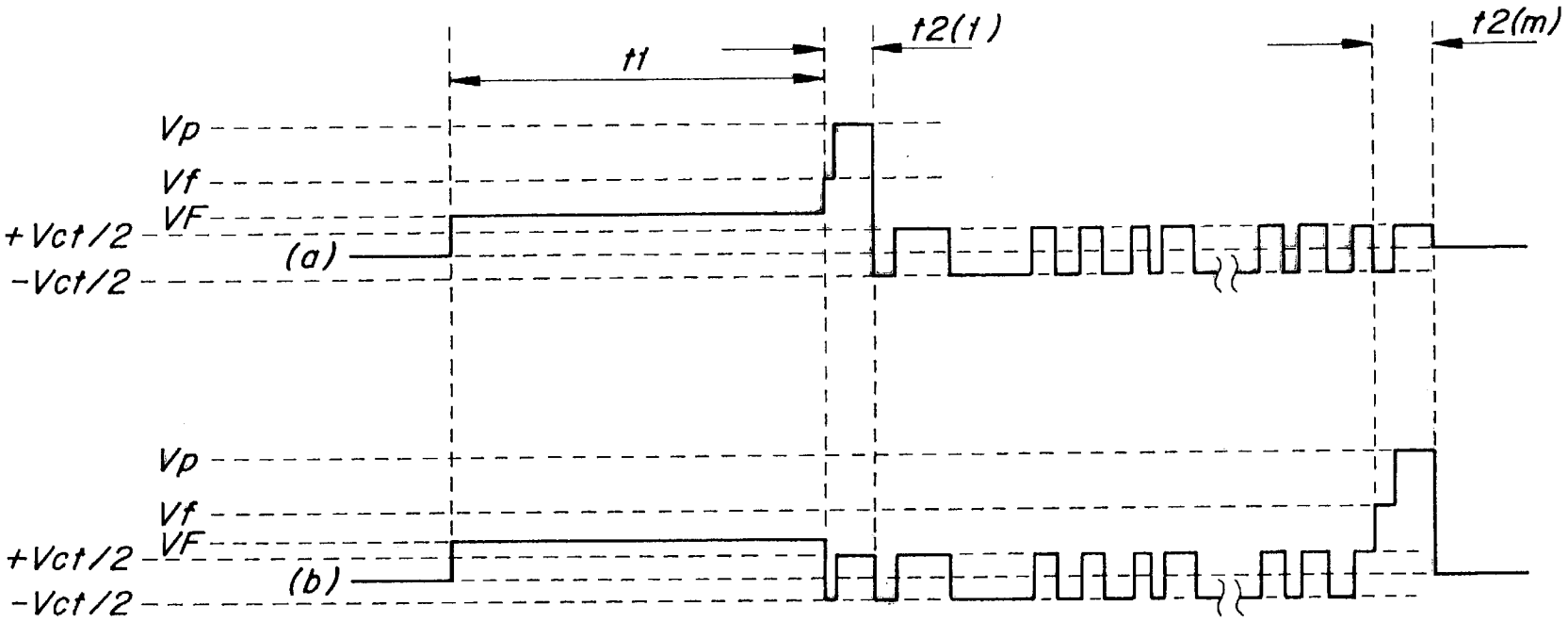
FIG. 27 is a chart diagram showing voltage waveforms used in a seventh embodiment.

FIG. 27 shows the voltage waveforms applied to the liquid crystal according to the seventh embodiment. Waveform (a) is the voltage waveform applied to the liquid crystal forming the pixels on the scanning electrode for the first line, and waveform,(b) is the voltage waveform applied to the liquid crystal forming the pixels on the scanning electrode for the m-th line. In the waveform (a), the reset signal has a voltage VF and a pulse width t1, and the select signal has a pulse width t2 and consists of the application period of voltage Vp and the application period of voltage Vf. Between the waveforms (a) and (b), the reset signal is the same, but the pulse width of the select signal is different, i.e., t2(1) for the former and t2(m) for the latter. In this way, in the seventh embodiment, the pulse width of the select signal is different for each line. As a result, the pulse width of the cross talk signal is different for each scanning electrode select period, though its voltage is constant at $\pm Vct = \pm Vc/2$.

Here, the ratio of t2p to the pulse width t2(1)–t2(m) is the same for every select signal; therefore, for the input of the same image data, if the pulse width is increased, t2p also increases. Consequently, when the select signals such that t2(1)<t2(m) are applied, t2p becomes longer for the m-th line than for the first line. In this way, by adjusting the pulse width of the select signal for each line, t2p can be adjusted to correct the density unevenness from one scanning electrode to the next.

Figure 28:
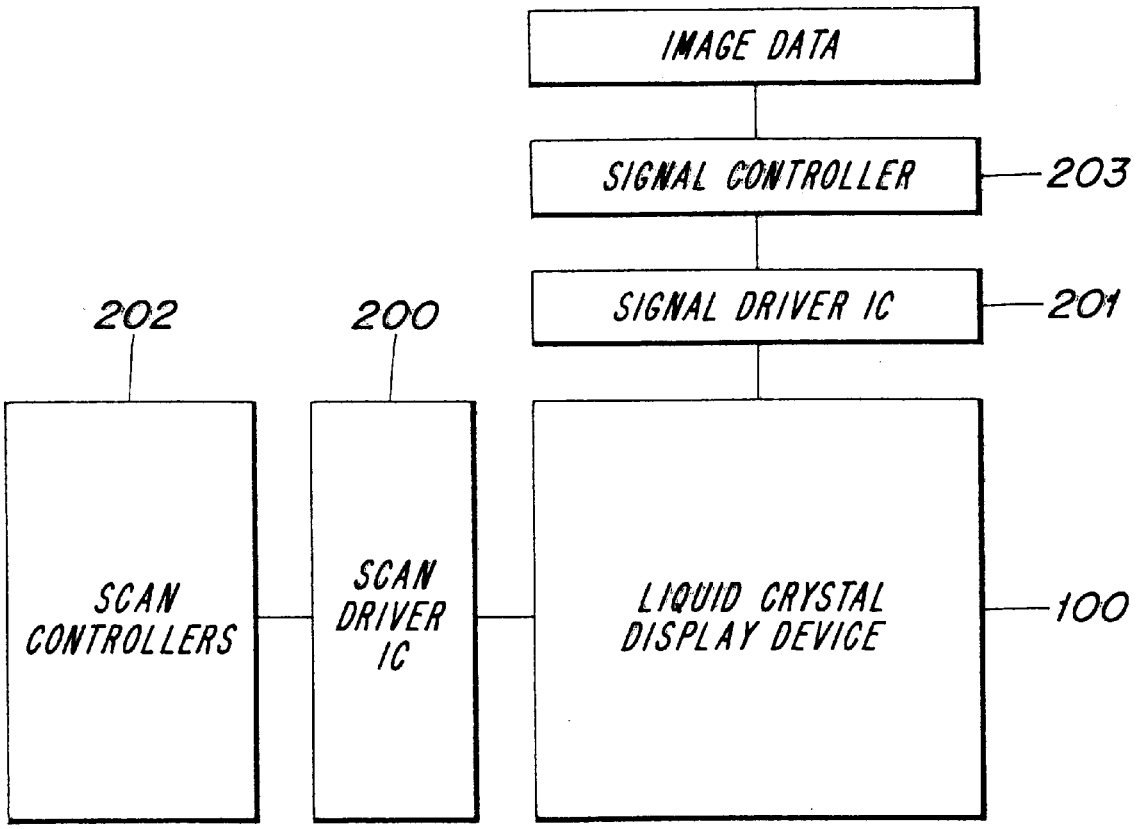
FIG. 28 is a block diagram showing drive circuits used in the seventh embodiment.

FIG. 28 shows the drive circuits for adjusting the pulse width, t2(1)–t2(m), of the select signal used in the seventh embodiment. The scan driver IC 200 and signal driver IC 201 are identical in configuration to those shown in FIGS. 22 and 23. Control signals input to the scan driver IC 200 from the scan controller 202 consist of the scan data and the scan shift clock input to the shift registers, and the scan strobe signal input to the latches. Control signals input to the signal driver IC 201 from the signal controller 203 consist of the image data and the data shift clock input to the shift registers, the data strobe signal input to the latches, and the count clock input to the 8-bit counter in the PWM circuit.

Figure 29:
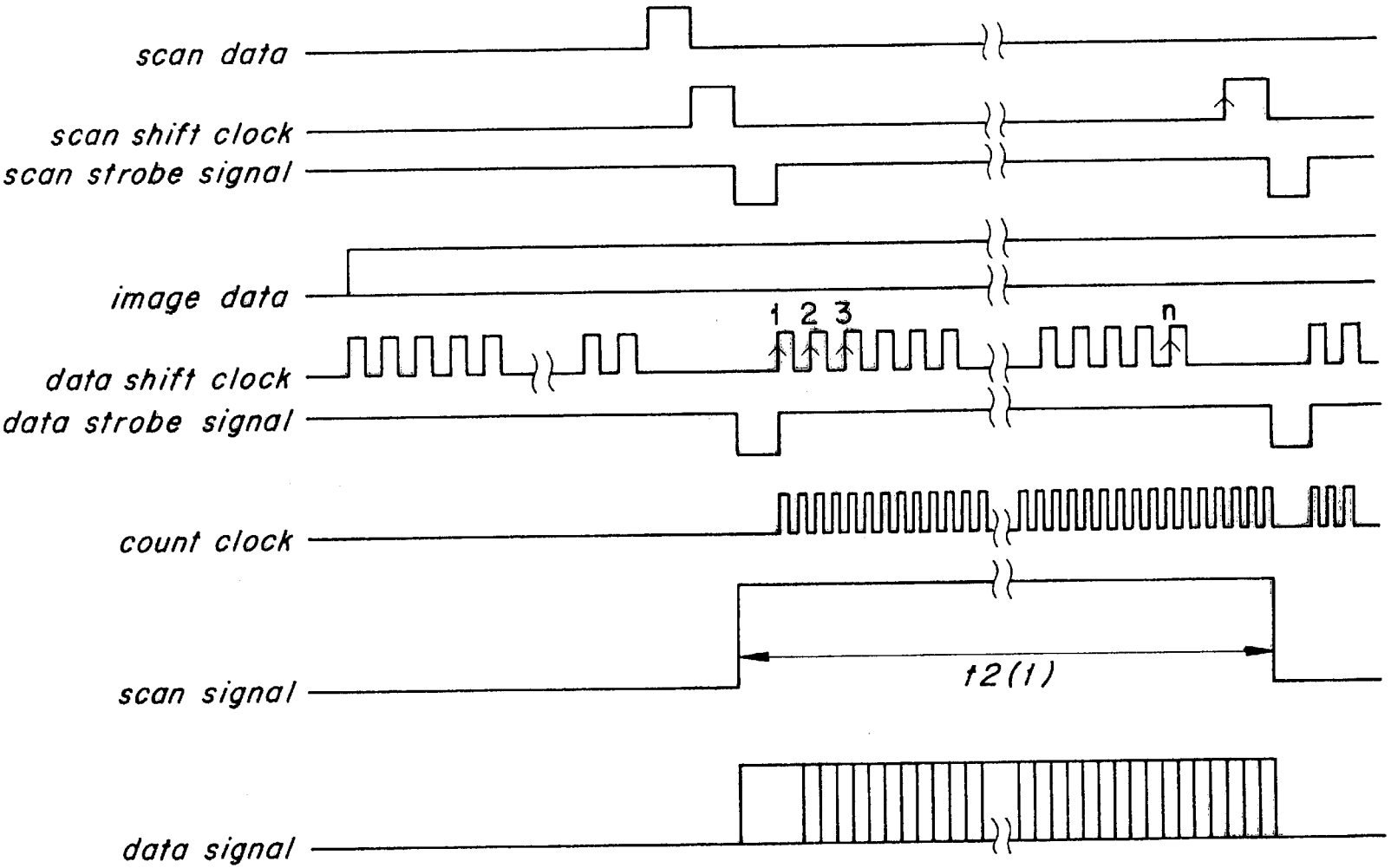
FIG. 29 is a chart diagram showing control signals used in the seventh embodiment.
Figure 30:
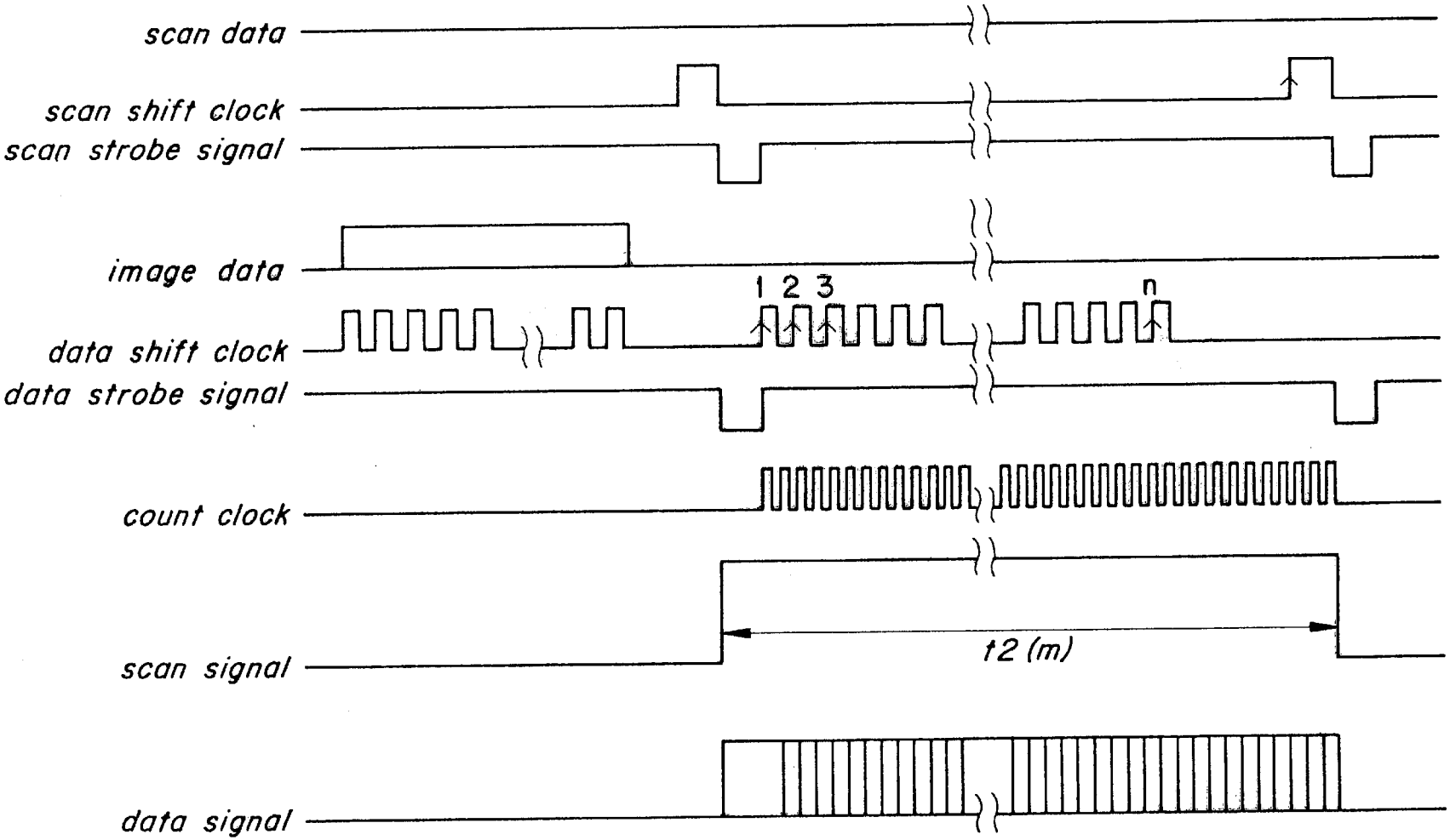
FIG. 30 is a chart diagram showing control signals used in the seventh embodiment.

In the seventh embodiment, to drive the liquid crystal with a waveform whose pulse width is different for each scanning electrode, the scan strobe signal input to the scan driver IC 200 and the data strobe signal and count clock input to the signal driver IC 201 are varied from one scanning electrode to the next. FIG. 29 shows the control signals when outputting the scan select signal for the first line, and FIG. 30 shows the control signals when outputting the scan select signal for the m-th line. As just stated, the scan strobe signal input to the scan driver IC 200 and the data strobe signal and count clock input to the signal driver IC 201 are different, but the other signals are the same. When the cycle of the scan strobe signal is made longer, the width of the output scan select signal increases. The data strobe signal is the same as the scan strobe signal. The cycle of the count clock is 1/256 of that of the data strobe signal, and can control the on period of the data signal in 256 gray scale levels. The cycle of the scan strobe signal and data strobe signal is determined by considering the relationship between t2p and Y value measured in advance.

By so doing, a voltage waveform having a pulse width different for each scanning electrode can be applied without having to convert the image data, and the density unevenness due to the difference in the time interval from the reset period to the select period can thus be suppressed. This eliminates the provision of image data conversion section such as an image data conversion table, and thus simplifies the drive circuit configuration.

EXAMPLE 7

Figure 31:
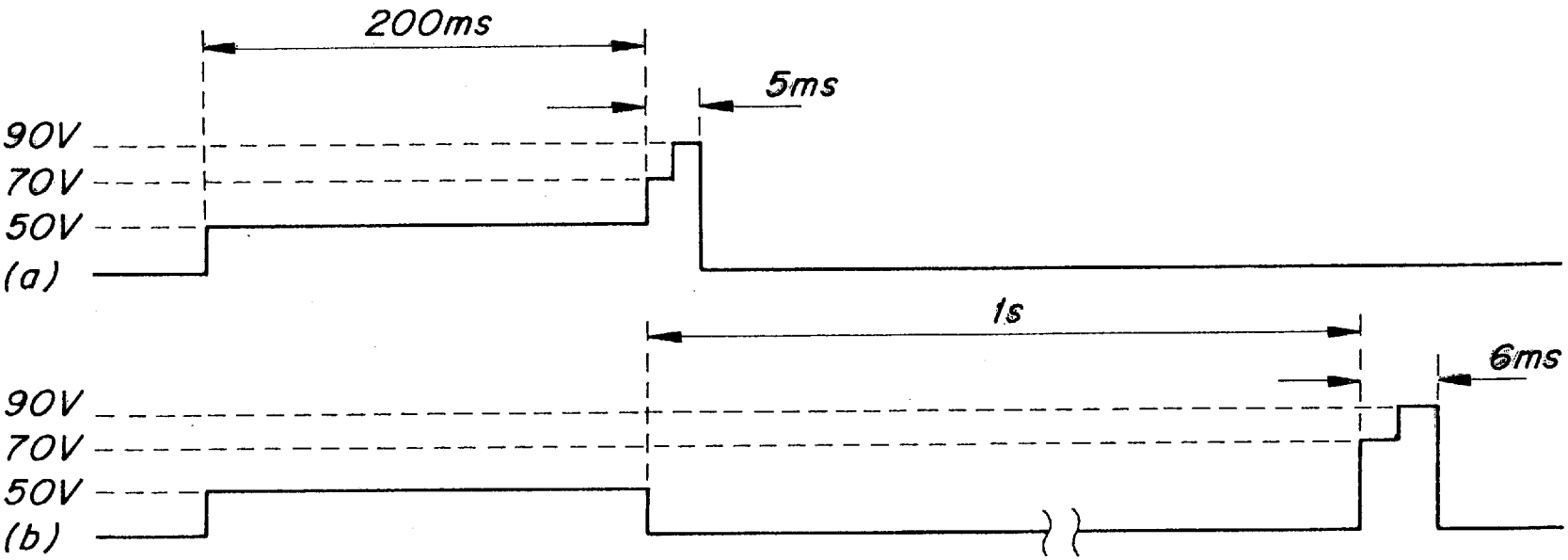
FIG. 31 is a chart diagram showing voltage waveforms used in Example 7.

The pulse voltages of the waveforms (a) and (b) shown in FIG. 31 were applied to the liquid crystal cell in the test cell. Here, the waveform (a) assumes the signal applied to the liquid crystal forming the pixels on the scanning electrode for the first line, and the waveform (b) assumes the signal applied to the liquid crystal forming the pixels on the scanning electrode for the 1000th line. Between the waveforms (a) and (b), the reset signal is the same, i.e., VF=50 V and t1=200 ms. The select signal in the waveform (a) is: Vp=90 V, Vf=70 V, and t2(1)=5 ms. In the waveform (b), assuming the signal for the 1000th line, the select signal of Vp=90V, Vf=70 V, and t2(1000)=6 ms was applied with a delay of one second after the application of the reset signal.

Figure 32:
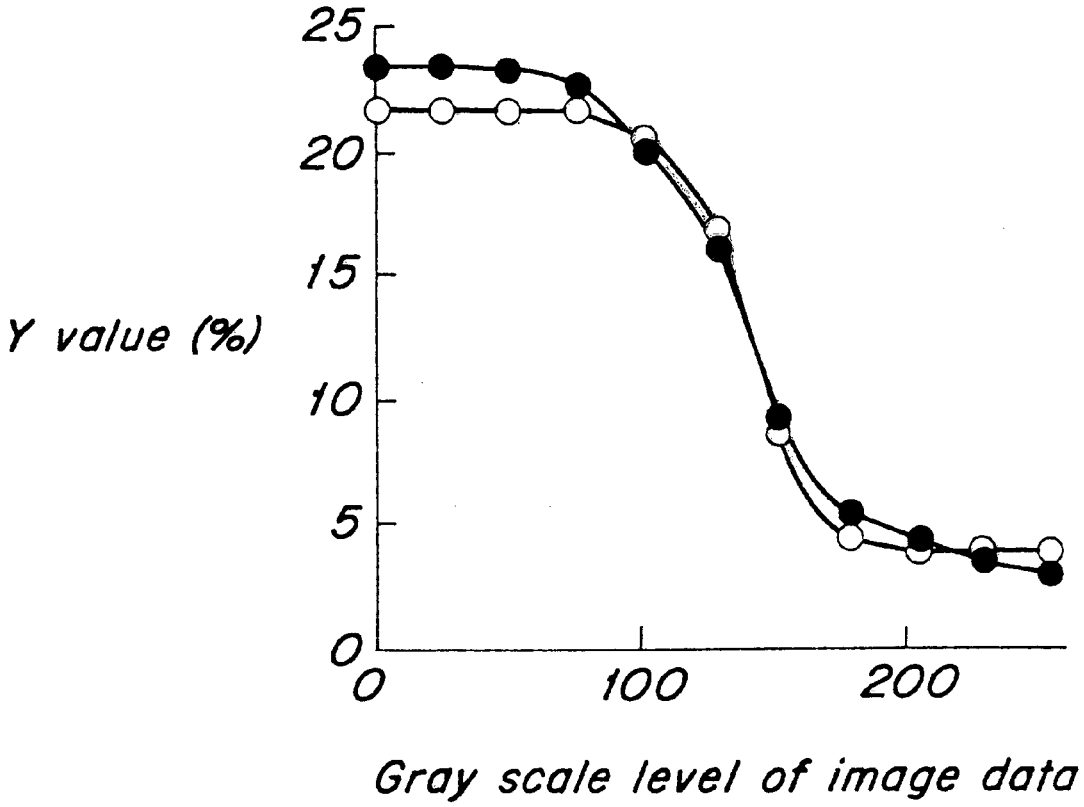
FIG. 32 is a graph showing the Y values obtained in Example 7.

The waveforms (a) and (b) shown in FIG. 31 both represent an example when displaying a gray shade exactly at midpoint of the gray scale by inputting image data 128. The pulse width for the first line is t2=5 ms, and the application time t2p of the voltage Vp is one half of that, i.e., 2.5 ms. FIG. 32 shows how the Y value changed when the image data was varied. The measured results for the first line are shown by open circles, and those for the 1000th line by solid circles. When compared with the results of FIG. 26 where no corrections were applied, the difference between the first line and the 1000th line for the input of the same image data is reduced according to the results of Example 7. Thus, by using the method of the seventh embodiment, it becomes possible to reduce the density unevenness caused by the difference in the time interval from the reset period to the select period.

Eighth Embodiment

Figure 33:
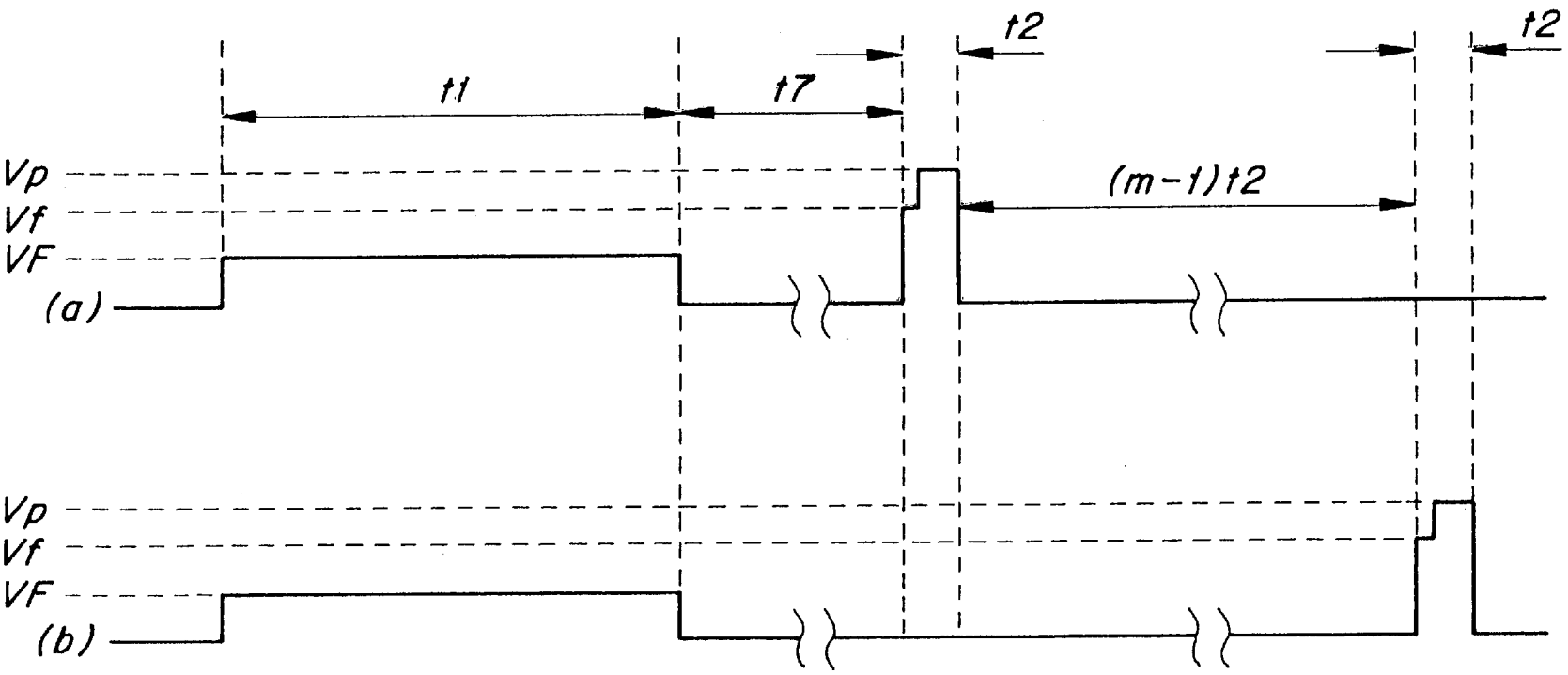
FIG. 33 is a chart diagram showing voltage waveforms used in an eighth embodiment.

Next, a driving method according to an eighth embodiment will be described. In the eighth embodiment, the waveforms (a) and (b) shown in FIG. 33 are applied to correct the density unevenness from one scanning electrode to the next as earlier described in the sixth embodiment. The waveform (a) is the voltage waveform applied to the liquid crystal forming the pixels on the scanning electrode for the first line, and the waveform (b) is the voltage waveform applied to the liquid crystal forming the pixels on the scanning electrode for the m-th line. In the waveform (a), the reset signal has a voltage VF and a pulse width t1, and the select signal has a pulse width t2 and consists of voltage Vp period and voltage Vf period, the ratio between the application periods of these voltages being varied. In the waveforms (a) and (b), a quiescent period t7, during which no voltage is applied to the liquid crystal, is provided between the reset period and the scanning period.

Immediately after the voltage is turned off, the liquid crystal driven by the present invention is not fully stabilized yet. Accordingly, with the driving method of the first embodiment, the liquid crystal state for the m-th line, immediately before the application of the select signal, is closer to the perfect focal conic state than that for the first line.

In the eighth embodiment, the provision of the quiescent period t7 allows the liquid crystal to be brought close to the perfect focal conic state by the time the select pulse signal is applied, even for the first line where the select pulse signal is applied for the first time after the application of the reset pulse signal. As a result, the liquid crystal stabilizes in the focal conic state for every line by the time the select pulse signal is applied, so that the same display state can be selected by the application of the same select signal. The density unevenness can thus be reduced.

In each of the first to seventh embodiments, the quiescent period t7 may be provided between the reset period and the scanning period, as in the eighth embodiment described here.

Ninth Embodiment

In the driving method of the fourth embodiment, after writing is done to the liquid crystal forming each pixel on the scanning electrode for the first line, the same liquid crystal is subjected to the cross talk voltage Vct through its associated signal electrode until after the last line is written. On the other hand, the liquid crystal forming each pixel on the scanning electrode for the last line enters into the display period immediately after the writing, and its display state is retained. As a result, density unevenness may occur in the display state from one scanning electrode to another because of the differences in the application time of the cross talk voltage Vct.

Figure 34:
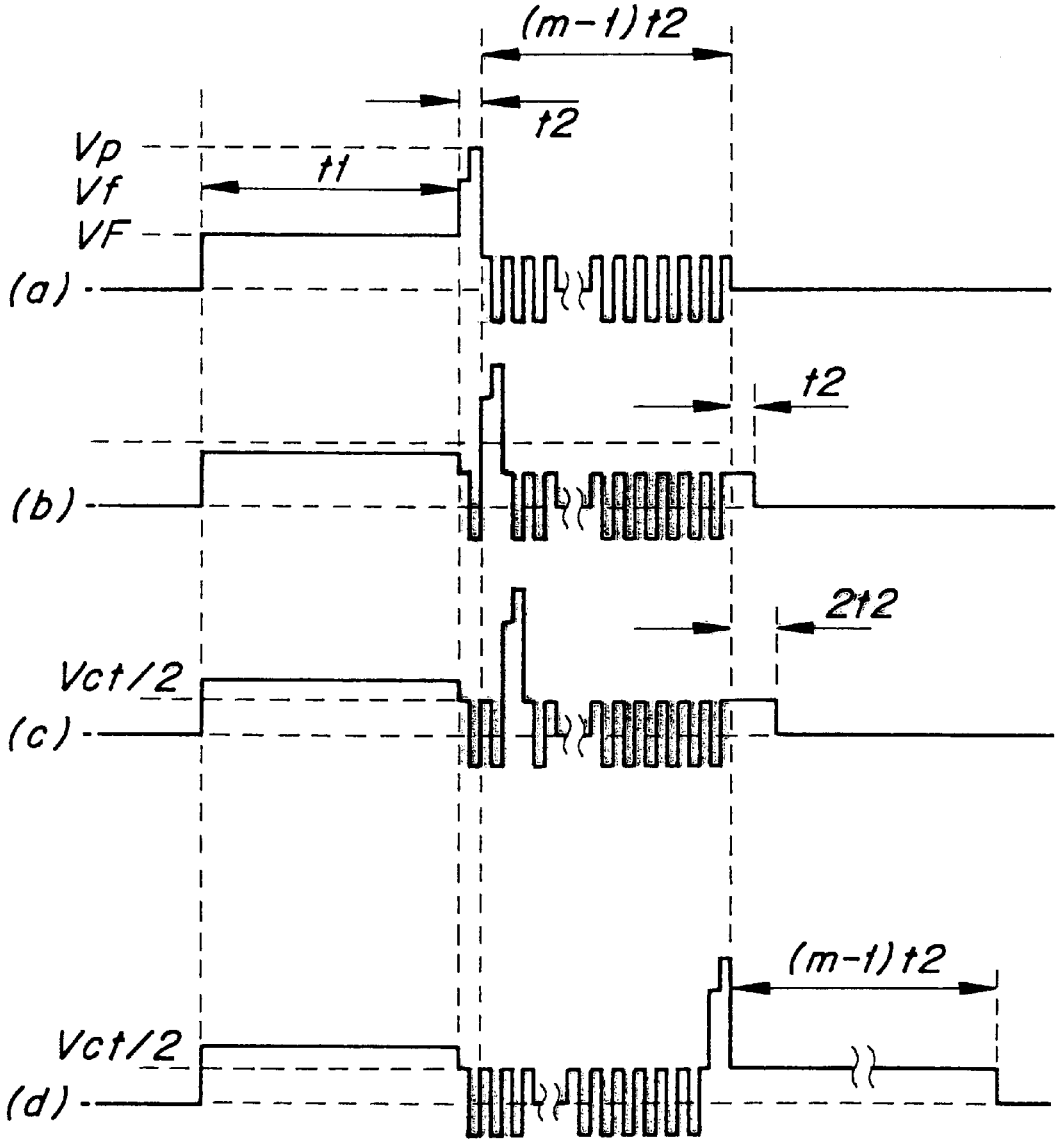
FIG. 34 is a chart diagram showing voltage waveforms used in a ninth embodiment.

In the ninth embodiment, to eliminate the density unevenness, a cross talk correction voltage whose absolute value is equal to that of the cross talk voltage Vct is applied from each scanning electrode after the last line is written. The voltage waveforms applied to the respective scanning electrodes are shown in FIG. 34. Waveform (a) is the voltage waveform applied to the liquid crystal forming the pixels on the scanning electrode for the first line, waveform (b) is the voltage waveform applied to the liquid crystal forming the pixels on the scanning electrode for the second line, waveform (c) is the voltage waveform applied to the liquid crystal forming the pixels on the scanning electrode for the third line, and waveform (d) is the voltage waveform applied to the liquid crystal forming the pixels on the scanning electrode for the m-th line. In FIG. 34, the reset signal has a voltage VF and a pulse width t1, and the select signal has a pulse width t2 and consists of voltage Vp and voltage Vf the ratio of whose application periods varies. The cross talk voltage Vet is Vct=(Vp−Vt)/2; voltages of both positive and negative polarities are applied constantly throughout the scanning period. No cross talk correction voltage is applied to the first line from its scanning electrode, but cross talk voltages having pulse widths of t2, 2t2, and (m−1)t2, respectively, are applied to the second line, the third line, and the m-th line, respectively.

By applying the voltage waveforms as shown in the ninth embodiment, the time during which the cross talk voltage Vct is applied after the application of the select signal becomes equal for the liquid crystal forming every pixel on every scanning line, which serves to suppress the density unevenness described above.

Figure 35:
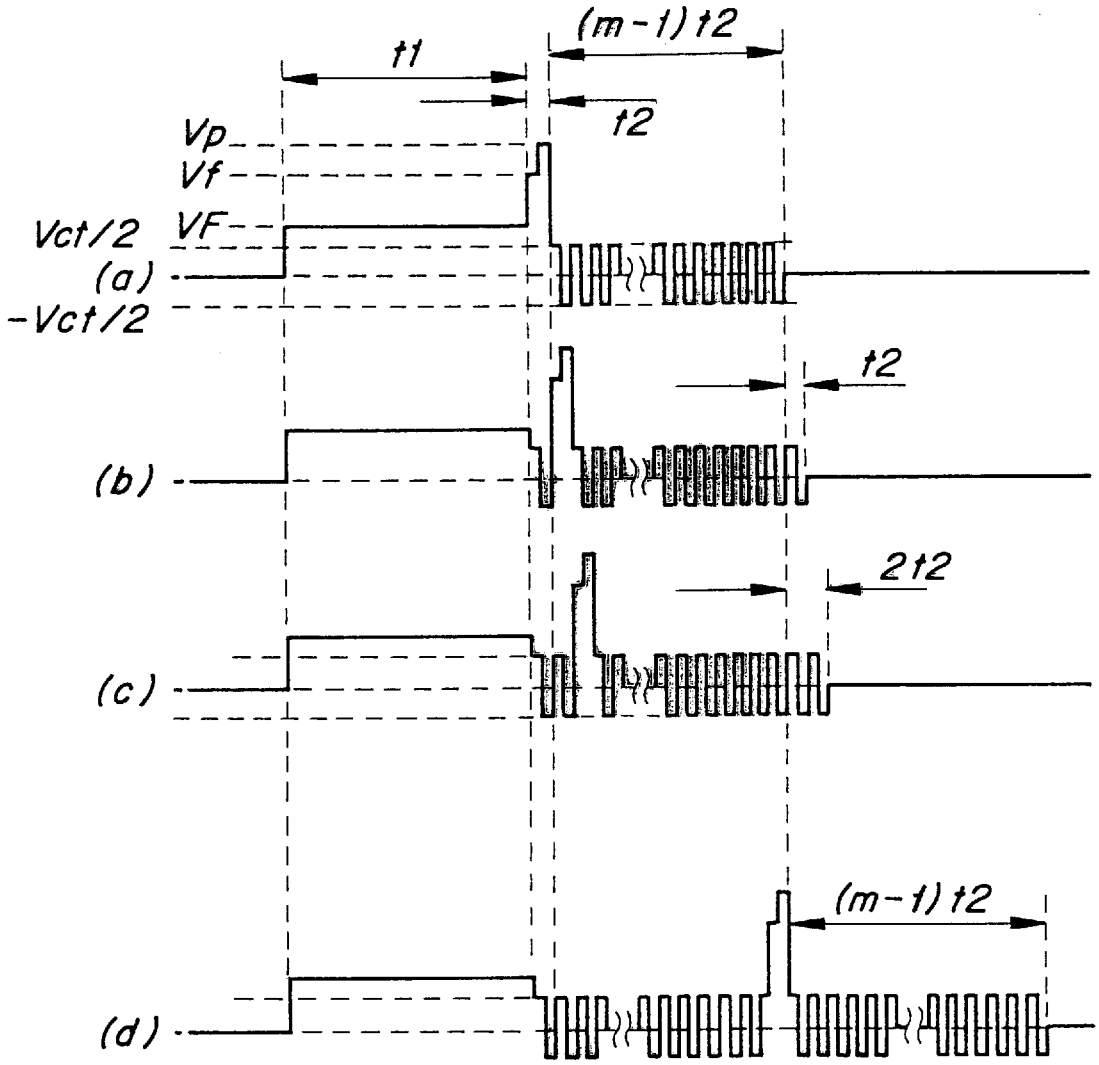
FIG. 35 is a chart diagram showing modified examples of the voltage waveforms used in the ninth embodiment.

The ninth embodiment has dealt with an example in which a DC voltage is used as the cross talk correction voltage applied from each scanning electrode after the completion of the scanning period, but instead, an AC voltage may be used here. An example where an AC voltage with a cycle of t2/2 is applied is shown in FIG. 35.

Tenth Embodiment

Figure 36:
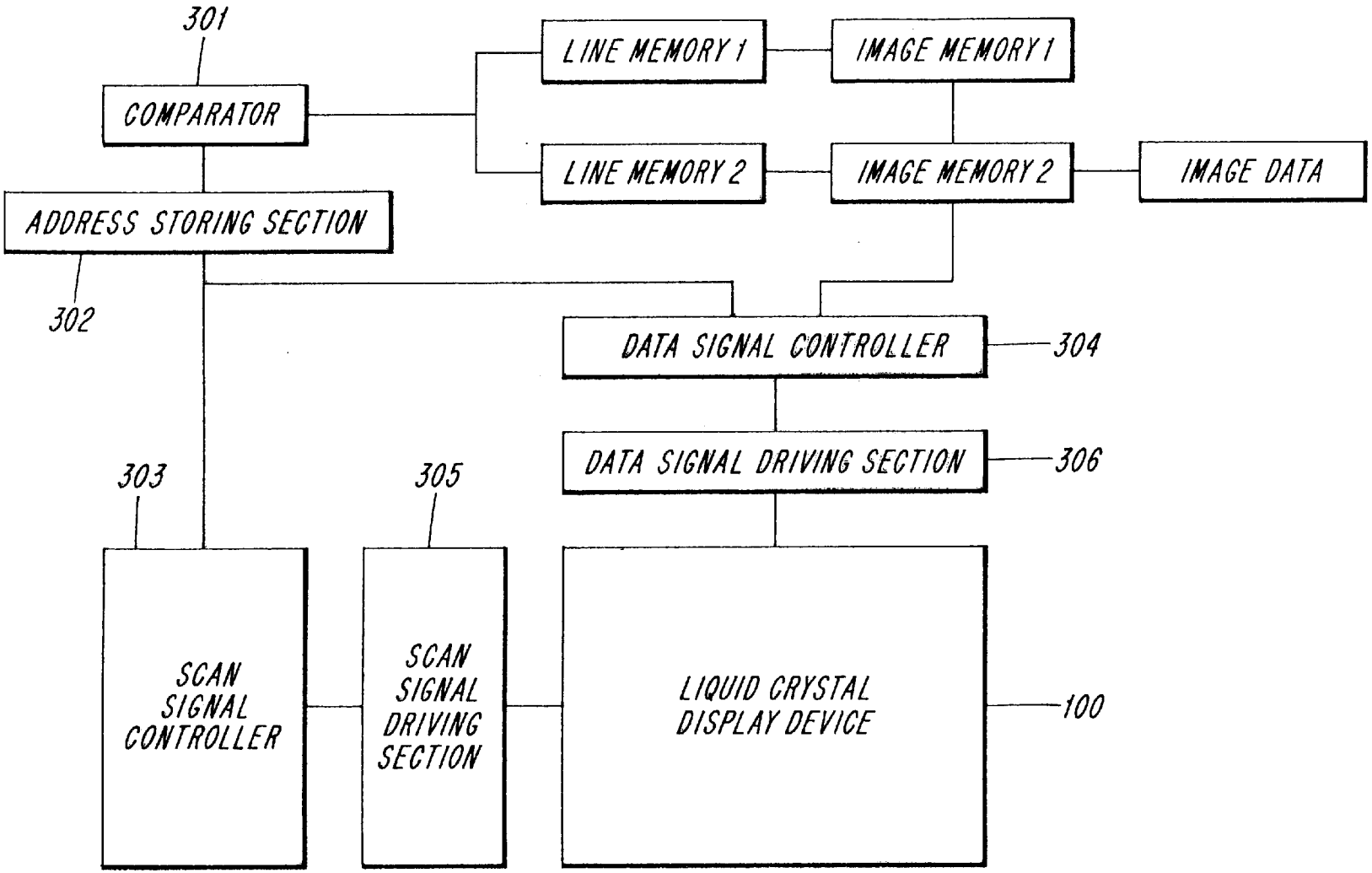
FIG. 36 is a block diagram showing drive circuits used in a 10th embodiment.

Since the liquid crystal device driven by the tenth embodiment has a memory characteristic, partial updating can be performed to update only a portion where a change has occurred. FIG. 36 shows the drive circuits necessary for performing the partial updating.

First, the current image data is stored in an image memory 1. New display image data is stored in an image memory 2. Data corresponding to one scanning electrode is read out of the image memory 1 and stored in a line memory 1. Likewise, data is read out of the image memory 2 and stored in a line memory 2. Data stored in the line memories 1 and 2 are compared in a comparator, and if they do not match, the associated line number is stored in an address storing section 302. In this way, only portions that have changed from the current image are extracted on a scanning electrode by scanning electrode basis, and these portions are updated.

By referring to the address stored in the address storing section 302, a scan signal controller 303 and a data signal controller 304 supply control signals to a scan signal driving section 305 and a data signal driving section 306 so that only the liquid crystal on the corresponding scanning electrode will be updated. In response to that, the scan signal driving section 305 and the data signal driving section 306 perform driving with a reset period, scanning period, and display period only on the liquid crystal designated for updating. According to this driving method, since only the portions that need updating can be updated, the screen can be displayed faster than the case where the whole screen is updated.

The configuration of the tenth embodiment can also be applied to each of the foregoing embodiments.

OTHER EMBODIMENTS

It will be appreciated that the driving method of the liquid crystal display device according to the present invention is not limited to that described in the illustrated embodiments, but various modifications can be made within the scope of the invention without departing the spirit thereof.

In particular, a test cell selectively reflecting green color has been used in each of the examples, but the test cell is not restricted to the illustrated one; rather, test cells providing other selective reflection wavelengths, such as red and blue, can be used, in which case also, similar effects can be obtained.

What is claimed is:

1. A driving method for a liquid crystal display device having a liquid crystal layer exhibiting a cholesteric phase and switchable between a planar state and a focal conic state according to the magnitude of an applied voltage, said method comprising the steps of:

in a first period, simultaneously applying a voltage to a plurality of pixels arranged in a matrix array, thereby resetting the plurality of pixels to the focal conic state; and in a second period after the first period, sequentially applying voltages respectively comprising pulse components having pulse widths which respectively correspond to image data of the pixels, thereby updating the display contents of the pixels.

2. A driving method for a liquid crystal display device according to claim 1, wherein said liquid crystal display device has a memory characteristic such that when no voltage is applied, the liquid crystal display is stable in a display state, said method further comprising the step of:

in a third period after the second period, retaining the display state by utilizing the memory characteristic of the liquid crystal.

3. A driving method for a liquid crystal display device according to claim 1, wherein the matrix of pixels are formed by an array of scanning electrodes driven by a scan driving section and an array of signal electrodes driven by a signal driving section, the method further comprising the steps of:

in the second period, applying a scan select signal to a given scanning electrode while, at the same time, applying a scan deselect signal to the other scanning electrodes, whereby selecting the given scanning electrode as a scan select electrode and the other scanning electrodes as scan deselect electrodes, and applying data signals to the signal electrodes in synchronism with the scan select signal.

4. A driving method for a liquid crystal display device according to claim 3, further comprising the steps of:

forming a select signal from a difference between the scan select signal and each data signal, which is applied to the liquid crystal forming each pixel on the scan select electrode to select its display state; and forming a deselect signal from a difference between the scan deselect signal and each data signal, which is applied to the liquid crystal forming each pixel on each scan deselect electrode.

5. A driving method for a liquid crystal display device according to claim 1, wherein in said first period, said method further comprising the step of:

applying a first voltage that is equal to or larger than a threshold voltage for setting the liquid crystal exhibiting the cholesteric phase into a homeotropic state before the liquid crystal is reset to the focal conic state.

6. A driving method for a liquid crystal display device according to claim 5, further comprising the step of:

applying a second voltage after the first voltage to cause the liquid crystal in the homeotropic state to change to the planar state.

7. A driving method for a liquid crystal display device according to claim 3, further comprising the step of:

varying the pulse width of each data signal, thereby varying the ratio of the application period of a voltage Vp, which is necessary to select the planar state, to the application period of a voltage Vf, which is necessary to select the focal conic state, in a select period during which the scan select signal is applied.

8. A driving method for a liquid crystal display device according to claim 7, wherein in the second period, the method further comprising the step of:

applying a voltage whose absolute value is $(Vp-Vt)/2$ to the liquid crystal during a deselect period during which the scan deselect signal is applied.

9. A driving method for a liquid crystal display device according to claim 3, wherein in the second period, the method further comprising the step of:

providing a quiescent period during which no voltage is applied to the liquid crystal between each of the data signals being applied successively.

10. A driving method for a liquid crystal display device according to claim 4, comprising a data converting section or converting image data for each scanning electrode, wherein in the second period, the method further comprising the step of:

varying the voltage of the select signal or the ratio of the application period of a voltage Vp, which is necessary to select the planar state, to the application period of a voltage Vf, which is necessary to select the focal conic state, for each scanning electrode by the image data conversion through the data converting section even when selecting the same display state.

11. A driving method for a liquid crystal display device according to claim 7, wherein in the second period, the method further comprising the step of:

varying the pulse width of the select period for each scanning electrode.

12. A driving method for a liquid crystal display device according to claim 1, further comprising the step of:

providing an additional period in which no voltage is applied to the liquid crystal between the first period and the second period.

13. A driving method for a liquid crystal display device according to claim 2, further comprising the step of:

providing an additional period during which voltages are not applied to all the signal electrodes but a voltage of a waveform different for each scanning electrode is applied between the second period and the third period.

14. A driving method for a liquid crystal display device according to claim 3, wherein said liquid crystal display device comprises first and second image memories for respectively storing all of current display data and all of new display data, and first and second line memories for sequentially reading data per scanning electrode from the first and second image memories, and for storing the read out data, said method further comprising the steps of:

comparing new display data with the corresponding current data on a scanning electrode by scanning electrode basis;

storing an address of a scanning electrode where the data compared in the comparing step do not match; and selectively driving the liquid crystal display device at the address stored in the address storing step.

15. A driving method for a liquid crystal display device having a matrix of pixels formed by an array of scanning electrodes driven by a scan driving section and an array of signal electrodes driven by a signal driving section, with a liquid crystal exhibiting a cholesteric phase being placed in operative association with the scanning electrodes and the signal electrodes, said liquid crystal display device having a memory characteristic such that when no voltage is applied, the liquid crystal display device is stable in one of the display states consisting of a planar state, a focal conic state, and [an] at least one intermediate state therebetween, wherein the liquid crystal display device is driven by applying voltages to the scanning electrodes and the signal electrodes from the scan driving section and the signal driving section, respectively, and by applying resulting difference voltages to the liquid crystal, said method comprising the steps of:

in a first period, simultaneously applying a scan reset signal to all the scanning electrodes and a data reset signal to all the signal electrodes, thereby applying a reset signal, formed from a difference between the scan reset signal and the data reset signal, to the liquid crystal in every pixel and thus resetting all the pixels to the focal conic state;

in a second period after the first period, applying a scan deselect signal to the other electrodes, and applying data signals, which respectively have pulse widths corresponding to image data, to the signal electrodes in synchronism with the scan select signal, thereby performing an update operation wherein a select signal, formed from a difference between the scan select signal and each data signal, is applied to the liquid crystal forming each pixel on the scan select electrode to select its display state, and a deselect signal, formed from a difference between the scan deselect signal and each data signal, is applied to the liquid crystal forming each pixel on each scan deselect electrode, said update operation being repeated by selecting the scanning electrodes one after another as the scan select electrode, thereby updating the display state of the liquid crystal forming all the pixels; and in a third period after the second period, applying a display retaining signal to all the scanning electrodes and signal electrodes so that the display state is retained by utilizing the memory characteristic of the liquid crystal.

16. A driving apparatus for a liquid crystal display device having a liquid crystal layer exhibiting a cholesteric phase and switchable between a planar state and a focal conic state according to the magnitude of an applied voltage, a plurality of scanning electrodes, and a plurality of signal electrodes, said driving apparatus comprising:

drive circuitry for driving said scanning and signal electrodes, including a scan driving section for driving said scanning electrodes, and a signal driving section for driving said signal electrodes;

wherein said drive circuitry is configured to, in a first period, simultaneously apply a voltage to a plurality of pixels arranged in a matrix array, thereby resetting the plurality of pixels to the focal conic state; and in a second period after the first period, sequentially apply voltages respectively comprising pulse components having pulse widths which respectively correspond to image data of the pixels, thereby updating the display contents of the pixels.

17. A driving apparatus for a liquid crystal display device according to claim 16, wherein said liquid crystal display device has a memory characteristic such that when no voltage is applied, the liquid crystal display is stable in a display state, wherein said display circuitry is configured to, in a third period after the second period, retain the display state by utilizing the memory characteristic of the liquid crystal.

18. A driving apparatus for a liquid crystal display device according to claim 16, wherein said display circuitry is configured to:

in the second period, select a given scanning electrode as a scan select electrode and the other scanning electrodes as scan deselect electrodes, and apply a scan select signal to the scan select electrode while, at the same time, applying a scan deselect signal to the scan deselect electrodes; and apply data signals to the signal electrodes in synchronism with the scan select signal.

19. A driving apparatus for a liquid crystal display device according to claim 18, wherein said drive circuitry is configured to:

form a select signal from a difference between the scan select signal and each data signal, which is applied to the liquid crystal forming each pixel on the scan select electrode to select its display state; and form a deselect signal from a difference between the scan deselect signal and each data signal, which is applied to the liquid crystal forming each pixel on each scan deselect electrode.

20. A driving apparatus for a liquid crystal display device according to claim 16, wherein in said first period, said drive circuitry is configured to:

apply a first voltage that is equal to or larger than a threshold voltage for setting the liquid crystal exhibiting the cholesteric phase into a homeotropic state before the liquid crystal is reset to the focal conic state.

21. A driving apparatus for a liquid crystal display device according to claim 20, wherein said drive circuitry is configured to:

apply a second voltage after the first voltage to cause the liquid crystal in the homeotropic state to change to the planar state.

22. A driving apparatus for a liquid crystal display device according to claim 18, wherein said drive circuitry is configured to vary the pulse width of each data signal, thereby varying the ratio of the application period of a voltage Vp, which is necessary to select the planar state, to the application period of a voltage Vf, which is necessary to select the focal conic state, in a select period during which the scan select signal is applied.

23. A driving apparatus for a liquid crystal display device according to claim 22, wherein in the second period, the drive circuitry is configured to:

apply a voltage whose absolute value is (Vp−Vf)/2 to the liquid crystal during a deselect period during which the scan deselect signal is applied.

24. A driving apparatus for a liquid crystal display device according to claim 18, wherein in the second period, the drive circuitry is configured to:

provide a quiescent period during which no voltage is applied to the liquid crystal between each of the data signals being applied successively.

25. A driving apparatus for a liquid crystal display device according to claim 19, further comprising a data converter for converting image data for each scanning electrode, wherein in the second period, the drive circuitry is configured to:

vary the voltage of the select signal or the ratio of the application period of a voltage Vp, which is necessary to select the planar state, to the application period of a voltage Vf, which is necessary to select the focal conic state, for each scanning electrode by the image data conversion through the data converter even when selecting the same display state.

26. A driving apparatus for a liquid crystal display device according to claim 22, wherein in the second period, the drive circuitry is configured to:

vary the pulse width of the select period for each scanning electrode.

27. A driving apparatus for a liquid crystal display device according to claim 16, wherein said drive circuitry is configured to:

provide an additional period in which no voltage is applied to the liquid crystal between the first period and the second period.

28. A driving apparatus for a liquid crystal display device according to claim 17, wherein said drive circuitry is configured to:

provide an additional period during which voltages are not applied to all the signal electrodes but a voltage of a waveform different for each scanning electrode is applied between the second period and the third period.

29. A driving apparatus for a liquid crystal display device according to claim 18, further comprising:

first and second image memories for storing all of current display data and all of new display data, respectively;

a device for sequentially reading data per scanning electrode from the first and second image memories, and for storing the readout data;

a comparing device for comparing new display data with the corresponding current data on a scanning electrode by scanning electrode basis;

a storage device for storing an address of a scanning electrode where the data compared in the comparing device do not match; and wherein the driving circuitry selectively drives the liquid crystal display device at the address stored in the address storage device.

30. A driving method for a liquid crystal display device having plural liquid crystal layers, each exhibiting a cholesteric phase and each switchable between a planar state and a focal conic state according to the magnitude of an applied voltage, said method comprising the steps of:

specifying a desired color;

selecting voltages to apply to said liquid crystal display layers based on said desired color, wherein the voltages are selected from:

(a) a highest voltage corresponding to a planar state;

(b) a lowest voltage corresponding to a focal conic state; and (c) at least one intermediate voltage which is selected between the highest voltage and the lowest voltage; and applying said selected voltages to respective layers.

31. An apparatus for driving a liquid crystal display device having plural liquid crystal layers, each exhibiting a cholesteric phase and each switchable between a planar state and a focal conic state according to the magnitude of an applied voltage, said apparatus comprising:

a drive circuit configured to select voltages to apply to said liquid crystal display layers based on a desired color, wherein the voltages are selected from:

(a) a highest voltage corresponding to a planar state;

(b) a lowest voltage corresponding to a focal conic state; and (c) at least one intermediate voltage which is selected between the highest voltage and the lowest voltage; and wherein said drive circuit is also configured to apply said selected voltages to respective layers.

32. A driving method for a liquid crystal display device having a liquid crystal layer exhibiting a cholesteric phase and a switchable between a planar state and a focal conic state according to the magnitude of an applied voltage, said method comprising the steps of:

in a first period, simultaneously applying a first voltage to a plurality of pixels arranged in a matrix array, thereby causing the plurality of pixels to be in a homeotropic state;

in a second period after the first period, simultaneously applying a second voltage to the plurality of pixels;

in a third period after the second period, simultaneously applying a third voltage to the plurality of pixels, thereby causing the plurality of pixels to be in the focal conic state; and in a fourth period after the third period, sequentially applying voltages corresponding to image data to the pixels, thereby updating the display contents of the pixels, wherein the second voltage Is smaller than both the first and third voltages.

33. A driving method for a liquid crystal display device according to claim 32, wherein, in the second period, the plurality of pixels tends to set to the planar state.

34. A driving method for a liquid crystal display device according to claim 32, wherein said liquid crystal display has a memory characteristic such that when no voltage is applied, the liquid crystal display is stable in a display state, said method comprising the step of:

in a fifth period after the fourth period, retaining the display state by utilizing the memory characteristic of the liquid crystal.

35. A driving method for a liquid crystal display device according to claim 1, wherein the focal conic state is a light-transmitting state for which liquid crystal in the focal conic state is substantially transparent.

36. A driving method for a liquid crystal display device according to claim 15, wherein the focal conic state is a light-transmitting state for which liquid crystal in the focal conic state is substantially transparent.

37. A driving apparatus for a liquid crystal display device according to claim 16, wherein the focal conic state is a light-transmitting state for which liquid crystal in the focal conic state is substantially transparent.

38. A driving method for a liquid crystal display device according to claim 30, wherein the focal conic state is a light-transmitting state for which liquid crystal in the focal conic state is substantially transparent.

39. An apparatus for driving a liquid crystal display device according to claim 31, wherein the focal conic state is a light-transmitting state for which liquid crystal in the focal conic state is substantially transparent.

40. A driving method for a liquid crystal display device according to claim 32, wherein the focal conic state is a light-transmitting state for which liquid crystal in the focal conic state is substantially transparent.

* * * * *